US006980191B2

(12) United States Patent
Nakamura et al.

(10) Patent No.: US 6,980,191 B2
(45) Date of Patent: Dec. 27, 2005

(54) DISPLAY APPARATUS, IMAGE CONTROL SEMICONDUCTOR DEVICE, AND METHOD FOR DRIVING DISPLAY APPARATUS

(75) Inventors: Takashi Nakamura, Kumagaya (JP); Nozomu Harada, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 702 days.

(21) Appl. No.: 09/842,800

(22) Filed: Apr. 27, 2001

(65) Prior Publication Data

US 2001/0035862 A1 Nov. 1, 2001

(30) Foreign Application Priority Data

Apr. 27, 2000 (JP) ..... 2000-127093
Oct. 20, 2000 (JP) ..... 2000-321530
Apr. 20, 2001 (JP) ..... 2001-123191

(51) Int. Cl.[7] ..... G09G 3/36

(52) U.S. Cl. ..... 345/98; 345/100; 345/103; 345/205

(58) Field of Search ..... 345/103, 87, 85, 345/89, 98, 99, 100, 204, 205, 206, 690

(56) References Cited

U.S. PATENT DOCUMENTS 5,170,158 A * 12/1992 Shinya ..... 345/98
5,739,887 A * 4/1998 Ueda et al. ..... 349/149
5,856,818 A * 1/1999 Oh et al. ..... 345/99
5,945,972 A * 8/1999 Okumura et al. ..... 345/98
6,072,456 A * 6/2000 Karube et al. ..... 345/98
6,307,531 B1 * 10/2001 Shin ..... 345/88
6,339,417 B1 * 1/2002 Quanrud ..... 345/98
6,344,850 B1 * 2/2002 Okumura et al. ..... 345/204
6,388,651 B1 5/2002 Kinoshita et al.
6,462,725 B1 * 10/2002 Orisaka ..... 345/98
6,664,943 B1 * 12/2003 Nakajima et al. ..... 345/98

* cited by examiner

*Primary Examiner*—Xiao Wu
(74) *Attorney, Agent, or Firm*—Oblon, Spivak, McClelland, Maier & Neustadt, P.C.

(57) ABSTRACT

It is an object of the present invention to provide a display apparatus which can be miniaturized and is operated stably even at high resolution.

The display apparatus according to the present invention includes a pixel array unit, a signal line driving circuit, and a scanning line driving circuit, each of which is formed by using a polysilicon TFT on a glass substrate, a control circuit, and a graphic controller IC. Since the graphic controller IC rearranges digital pixel data DATA in the inside, it is unnecessary to provide a gate array. Since the cycle of a clock signal CLK is twice as much as that of the digital pixel data DATA, the clock signal CLK having a frequency at which the polysilicon TFT normally operates can be supplied to the signal line driving circuit. Further, since the edge of the clock signal CLK is deviated from the changing position of the digital pixel data DATA and they are outputted, the signal line driving circuit can effectively capture the digital pixel data DATA.

32 Claims, 30 Drawing Sheets

| | | | | | | | | | | | | | | | | | | | | |
|---|---|---|---|---|---|---|---|---|---|---|---|---|---|---|---|---|---|---|---|---|
| DATA-a[5:0] | R1 | R5 | R9 | R13 | … | R305 | R309 | R313 | R317 | BLK | R2 | R6 | R10 | R14 | … | R306 | R310 | R314 | R318 |
| DATA-b[5:0] | R3 | R7 | R11 | R15 | … | R307 | R311 | R315 | R319 | BLK | R4 | R8 | R12 | R16 | … | R308 | R312 | R316 | R320 |
| DATA-c[5:0] | R637 | R633 | R629 | R625 | … | R333 | R329 | R325 | R321 | BLK | R638 | R634 | R630 | R626 | … | R334 | R330 | R326 | R322 |
| DATA-d[5:0] | R639 | R635 | R631 | R627 | … | R335 | R331 | R327 | R323 | BLK | R640 | R636 | R632 | R628 | … | R336 | R332 | R328 | R324 |
| | G1 | G5 | G9 | G13 | … | G305 | G309 | G313 | G317 | BLK | G2 | G6 | G10 | G14 | … | G306 | G310 | G314 | G318 |
| | G3 | G7 | G11 | G15 | … | G307 | G311 | G315 | G319 | BLK | G4 | G8 | G12 | G16 | … | G308 | G312 | G316 | G320 |
| BLANKING PERIOD | G637 | G633 | G629 | G625 | … | G333 | G329 | G325 | G321 | BLK | G638 | G634 | G630 | G626 | … | G334 | G330 | G326 | G322 |
| | G639 | G635 | G631 | G627 | … | G335 | G331 | G327 | G323 | BLK | G640 | G636 | G632 | G628 | … | G336 | G332 | G328 | G324 |
| | B1 | B5 | B9 | B13 | … | B305 | B309 | B313 | B317 | BLK | B2 | B6 | B10 | B14 | … | B306 | B310 | B314 | B318 |
| | B3 | B7 | B11 | B15 | … | B307 | B311 | B315 | B319 | BLK | B4 | B8 | B12 | B16 | … | B308 | B312 | B316 | B320 |
| BLANKING PERIOD | B637 | B633 | B629 | B625 | … | B333 | B329 | B325 | B321 | BLK | B638 | B634 | B630 | B626 | … | B334 | B330 | B326 | B322 |
| | B639 | B635 | B631 | B627 | … | B335 | B331 | B327 | B323 | BLK | B640 | B636 | B632 | B628 | … | B336 | B332 | B328 | B324 |

FIG. 18

DISPLAY APPARATUS, IMAGE CONTROL SEMICONDUCTOR DEVICE, AND METHOD FOR DRIVING DISPLAY APPARATUS

CROSS REFERENCE TO RELATED APPLICATIONS

This application claims benefit of priority under 35USC § 119 to Japanese Patent Application No. 2000-127093 filed on Apr. 27, 2000, No. 2000-321530 filed on Oct. 20, 2000, and No. 2001-123191 filed on Apr. 20, 2001, the entire contents of which are incorporated by reference herein.

BACKGROUND OF THE INVENTION

1. Field of the Invention

The present invention relates to a display apparatus in which display elements and a driving circuit are formed on the same insulating substrate, an image control semiconductor device, and a method for driving the display apparatus.

2. Related Background Art

A display apparatus in which a large number of display elements were arranged laterally and longitudinally on an insulating substrate has been known. As a representative example, there is a liquid crystal display apparatus.

In this kind of conventional display apparatus, separately from a pixel array substrate on which the display elements are arranged laterally and longitudinally, a driving circuit substrate is generally provided. For example, active matrix type display elements are formed near respective points of intersection of signal lines and scanning lines arranged laterally and longitudinally on the pixel array substrate. In addition, on the pixel array substrate, a signal line driving circuit for driving the signal lines and a scanning line driving circuit for driving the scanning lines are formed.

On the other hand, on the driving circuit substrate, agraphic controller IC for performing image processes such as development to a bit map and the like in accordance with an instruction from a CPU, and an LCD controller IC for performing rearrangement of the pixel data outputted from the graphic controller in accordance with structure and drive of the pixel array substrate and generating a signal to control peripheral circuits of the pixel array substrate and the display apparatus are formed. The LCD controller IC is constructed by a gate array or the like.

FIG. 36 is a block diagram of a conventional liquid crystal display apparatus and shows a case in which a pixel array portion 109 and a part of driving circuits (signal line driving circuit, scanning line driving circuit, and the like) are formed on a glass substrate by using polysilicon TFT's, and a CPU 100, a graphic controller IC 101, and a gate array (G/A) 102 are formed on the other substrate.

Referring to FIG. 36, the gate array 102 rearranges digital pixel data outputted from the graphic controller IC 101 and controls the peripheral circuits of the pixel array substrate and the display apparatus. An output of the gate array 102 is inputted to a D/A converter (DAC) 106 through a control circuit 103, a sampling circuit 104, and a latch circuit 105. The D/A converter 106 converts the digital pixel data into an analog voltage. After the analog voltage is amplified by an amplifier (AMP) 107, the voltage is selected by a selecting circuit 108 and is supplied to each signal line 109.

To realize a reduction in part costs and a miniaturization, it is necessary to reduce the number of parts, substrate area, and number of substrates. In the conventional display apparatus, since the driving circuit is constructed by using a plurality of circuits such as graphic controller IC 101, gate array 102, signal line driving circuit, and scanning line driving circuit, there is such a problem that the scale of the driving circuit cannot be reduced.

Recently, in the liquid crystal display apparatus, a technique of forming polysilicon TFT's (Thin Film Transistors), which can be operated at a high operating speed, on the glass substrate and forming not only the pixel array portion but also a part of the driving circuit on the glass substrate is advancing.

Though the polysilicon TFT can be operated at a high speed, however, the mobility is not so high. When the resolution is raised to shorten a cycle per pixel, the polysilicon TFT does not operate stably. Accordingly, hitherto, the graphic controller IC 101 and similar components, to which the high-speed operation is required, are generally provided on the outside of the glass substrate. The whole driving circuit cannot be formed so as to be integrated with the pixel array portion.

In the conventional liquid crystal display apparatus, data buses are arranged on the glass substrate. As the number of signal lines is larger in association with the large area of the glass substrate, the load capacity of the data bus is increased. When the load capacity of the data bus is increased, such a problem that the waveform becomes dull occurs. Accordingly, hitherto, the voltage amplitude of data to be transmitted through the data bus is increased. However, when the voltage amplitude of data to be transmitted through the data bus is increased, there is such a problem that power consumption is increased.

SUMMARY OF THE INVENTION

The present invention is made in consideration of the above-mentioned problems. It is an object of the invention to provide a display apparatus in which a reduction in size can be realized, which can be operated stably even in case of high resolution, and in which the power consumption can be reduced, an image control semiconductor device, and a method for driving the display apparatus.

To accomplish the above object, according to the invention, there is provided a display apparatus comprising:

signal lines and scanning lines arranged laterally and longitudinally on an insulating substrate;

display elements formed near respective points of intersection of said signal lines and said scanning lines;

a signal line driving circuit, which is formed on said insulating substrate, configured to drive the signal lines;

a scanning line driving circuit, which is formed on the insulating substrate, configured to drive the scanning lines; and a graphic controller IC configured to output digital pixel data in order according to the order of driving the signal lines by said signal line driving circuit, wherein said graphic controller IC outputs a clock signal in a cycle twice as much as that of the digital pixel data, and the signal line driving circuit and said scanning line driving circuit drive the signal lines and the scanning lines synchronously with the clock signal, respectively.

According to the present invention, since the graphic controller IC outputs the clock signal in a cycle that is twice or more as much as that of the digital pixel data, even when the display resolution is high, it is unnecessary to set the frequency of the clock signal higher than the fastest frequency of the pixel data. Since the graphic controller IC outputs the digital pixel data in a state in which the data has been rearranged in accordance with the order of driving the signal lines and display control signals other than a basic start pulse can be generated on the insulating substrate, a gate array to perform the rearranging operation or generating display control signals is not needed, so that the circuit scale and number of peripheral ICs can be reduced.

Further, when the graphic controller IC is mounted on the insulating substrate on which the display elements are formed, the display elements and the whole driving circuit can be arranged on the same insulating substrate, so that a reduction in size and cost can be realized.

Since the frequency of the clock signal outputted from the graphic controller IC is set so that it is not so high, even in the case of a display element such as a polysilicon TFT whose mobility (operating speed) is not so high, the element can be stably operated.

Further, since the phase of the clock signal and that of the digital pixel data, which are outputted from the graphic control IC, can be adjusted in the inside of the graphic controller IC, the digital pixel data can be effectively captured in the signal line driving circuit on the basis of the clock signal.

According to the present invention, since a plurality of data buses are arranged from substantially the center of one side of the insulating substrate toward both the ends of the side, the load capacity of the data bus can be reduced and the voltage amplitude of data transmitted through the data bus can be reduced, so that a reduction in power consumption can be realized.

Further, since the signal lines are driven every plural lines, it is unnecessary to provide a D/A converting circuit for each signal line, so that a reduction in peripheral area occupied by the D/A converting circuit and a reduction in power consumption can be realized.

According to the present invention, there is provided a display apparatus comprising:

signal lines and scanning lines arranged laterally and longitudinally on an insulating substrate;

display elements formed near respective points of intersection of said signal lines and said scanning lines;

a signal line driving circuit, which is formed on the insulating substrate, configured to drive the signal lines;

a scanning line driving circuit, which is formed on the insulating substrate, configured to drive the scanning lines;

a plurality of data buses arranged from substantially the center of one side of the insulating substrate toward both the ends of said side; and an order control circuit configured to control the order of digital pixel data transmitted through the data buses so that the signal lines are simultaneously driven every plural lines by said signal line driving circuit.

According to the present invention, there is provided a display apparatus comprising:

a memory cell comprising a plurality of 1-bit memories arranged laterally and longitudinally;

a display layer in which display can be variably controlled according to the values of the plurality of 1-bit memories;

a writing control circuit configured to control the writing operation to the memory cell;

a plurality of data buses arranged from substantially the center of one side of an insulating substrate toward both the ends of said side; and an order control circuit configured to control the order of digital pixel data to be transmitted on the data buses so that the 1-bit memories are simultaneously driven every plural memories by the writing control circuit.

According to the present invention, there is provided a display apparatus comprising:

signal lines and scanning lines arranged laterally and longitudinally on an insulating substrate;

display elements formed near respective points of intersection of said signal lines and said scanning lines;

a signal line driving circuit, which is formed on said insulating substrate, configured to drive the signal lines; and a scanning line driving circuit, which is formed on the insulating substrate, configured to drive the scanning lines, wherein the signal line driving circuit latches on the state of separating the digital pixel data of a first color in one horizontal line into the odd pixels and the even pixels, and then after passing a prescribed period, latches on the state of separating the digital pixel data of a second color into the odd pixels and the even pixels, and performs D/A conversion for the latched data of said first color, and supplies the D/A converted data to the corresponding signal line, and then after passing a prescribed period, latches on the state of separating the digital pixel data of a third color into the odd pixels and the even pixels, and performs D/A conversion for the latched data of said second color, and supplies the D/A converted data to the corresponding signal line, and then after passing a prescribed period, performs D/A conversion for the latched data of said third color, and then after passing a prescribed period, supplies the D/A converted data to the corresponding signal line.

According to the present invention, there is provided an image control semiconductor device comprising:

a VRAM control unit configured to control the reading/writing operation of an image memory to store digital pixel data;

an output order control circuit configured to change output order of said digital pixel data in accordance with the order of driving signal lines;

a pixel data output unit configured to divide a plurality of signal lines arranged on an insulating substrate into n blocks (n is an integer larger than or equal to 2) and outputting the digital pixel data rearranged by said output order control circuit in parallel to said respective n blocks in parallel; and a first start pulse output unit configured to output a first start pulse signal to designate the driving start a signal line driving circuit for each of said n blocks, wherein said pixel data output unit divides said digital pixel data into a plurality of consecutive output data group, and outputs in sequence each of the consecutive output data group by spacing a prescribed period.

According to the present invention, there is provided an image control semiconductor device comprising:

a VRAM control unit configured to control the reading/writing operation of an image memory to store digital pixel data;

a readout address generating unit configured to form a readout address of the image memory;

a pixel data output unit configured to divide a plurality of signal lines arranged on an insulating substrate into n blocks (n is an integer larger than or equal to 2) and outputting digital pixel data read out from said image memory in accordance with the address formed by said readout address generating unit in parallel to said n blocks, respectively; and a first start pulse output unit configured to output a first start pulse signal to designate the driving start the signal lines to the n blocks, respectively, wherein the readout address generating unit generates read-out address of said image memory so that the digital pixel data in said block is divided into p consecutive outputted small data groups (p is an integer of 2 or more), and each of these small data groups is outputted by spacing a prescribed period.

According to the present invention, there is provided an image control semiconductor device comprising:

a VRAM control unit configured to control read/write for an image memory configured to store digital pixel data;

a read-out address generator configured to generate read address of said image memory;

first order control means configured to divide a plurality of signal lines arranged on an insulating substrate into n blocks (n is an integer larger than or equal to 2) and to read out the digital pixel data corresponding to address generated by said read-out address generator from said image memory, by each of said n blocks;

second order control means configured to change order of the digital pixel data by each of said n blocks read out by said first order control means into p consecutive outputted small data groups (p is an integer of 2 or more), and to output each of these small data groups by spacing a prescribed period; and a terminal configured to output a start pulse prior to each of the p small data groups.

BRIEF DESCRIPTION OF THE DRAWINGS

FIG. 18 is a diagram showing the arranging order of data on the data buses;

DESCRIPTION OF THE PREFERRED EMBODIMENTS

A display apparatus according to the present invention will now be specifically described hereinbelow with reference to the drawings. As an example of the display apparatus, an active matrix type liquid crystal display apparatus having a TFT (Thin Film Transistor) every pixel will be explained mainly.

Figure 1:
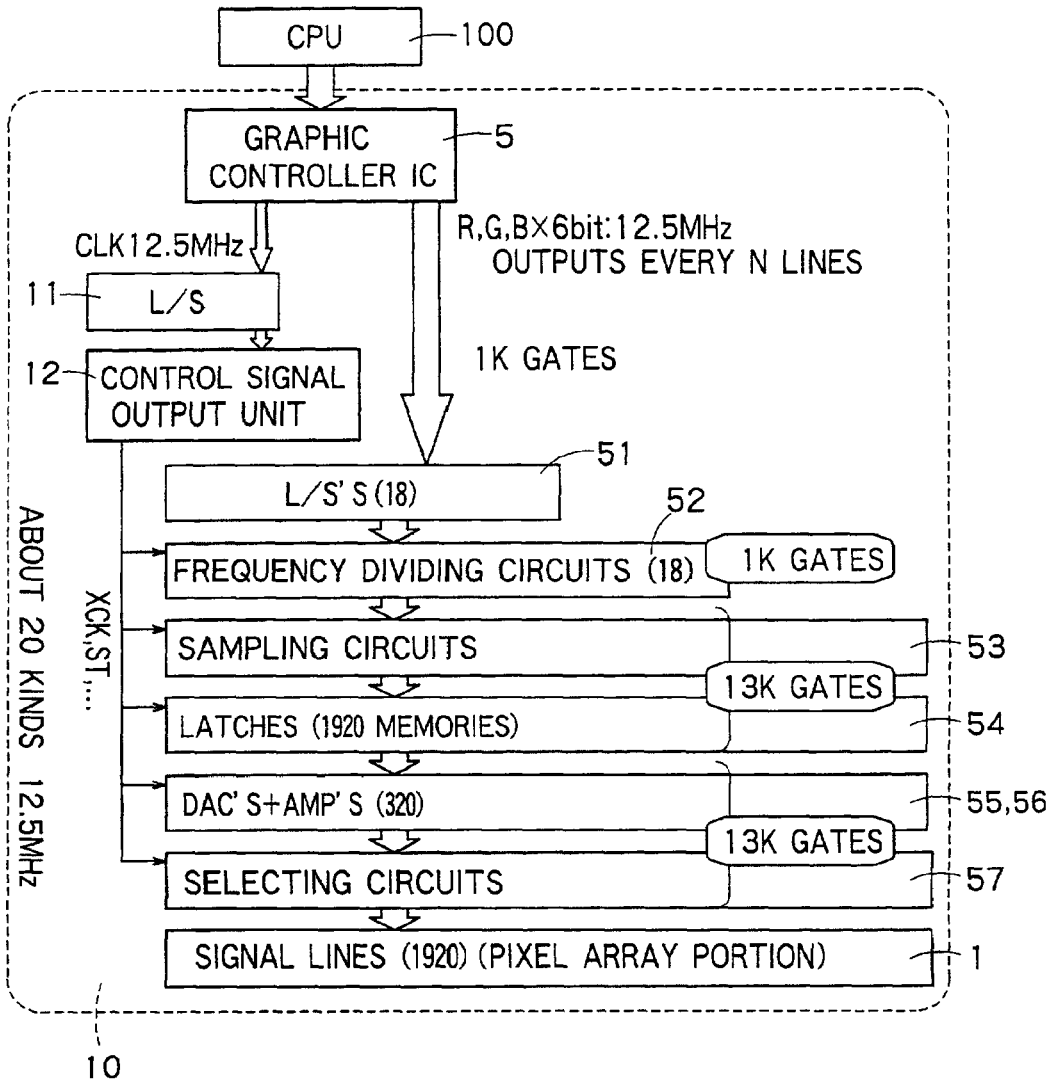
FIG. 1 is a block diagram of a display apparatus of an embodiment according to the present invention.

FIG. 1 is a block diagram of a display apparatus of an embodiment according to the present invention. The display apparatus of FIG. 1 has such characteristics that, as compared with a conventional display apparatus, an LCD controller IC (gate array) for transmitting and receiving signals to/from a pixel array portion is omitted and a graphic controller IC 5 is mounted on a glass substrate on which the pixel array portion is formed.

FIG. 1 illustrates a portion alone concerned with driving of signal lines. A signal line driving circuit 2, which is formed on a glass substrate 10 by using a polysilicon TFT, receives a signal from the graphic controller IC 5 to drive respective signal lines arranged on a pixel array portion 1.

Figure 2:
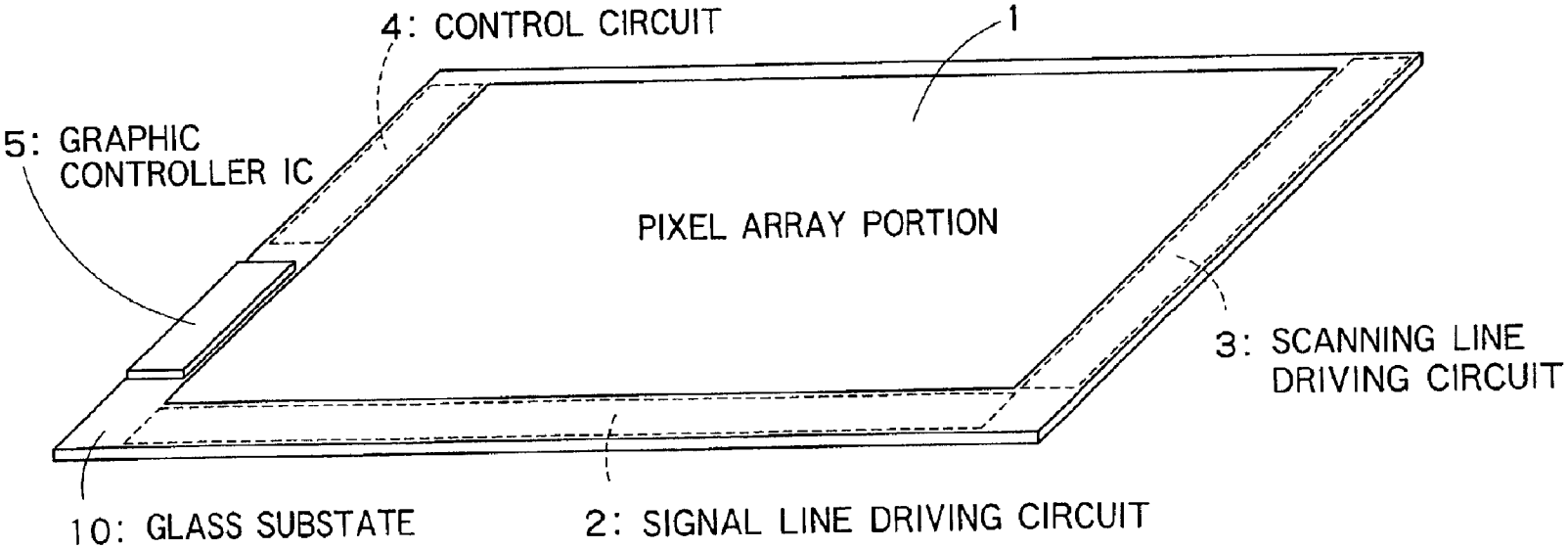
FIG. 2 is a perspective view of the display apparatus in FIG. 1.

FIG. 2 is a perspective view of the display apparatus of FIG. 1. As shown in the diagram, on the glass substrate 10, the pixel array portion 1, signal line driving circuit 2, a scanning line driving circuit 3, and a control circuit 4 are formed by using the polysilicon TFT's, respectively. The graphic controller IC 5 is mounted on the edge of the glass substrate 10. An IC chip (for example, a CPU or a display memory) other than the graphic controller IC 5 may be mounted on the glass substrate 10.

As shown in FIG. 1, the control circuit 4 includes a level shifter (L/S) 11 for converting a voltage level of each of various control signals (synchronization signal, load signal L, clock signal CLK, and the like) outputted from the graphic controller IC 5, and a control signal output unit 12 for controlling respective sections in the signal line driving circuit 2.

Figure 36:
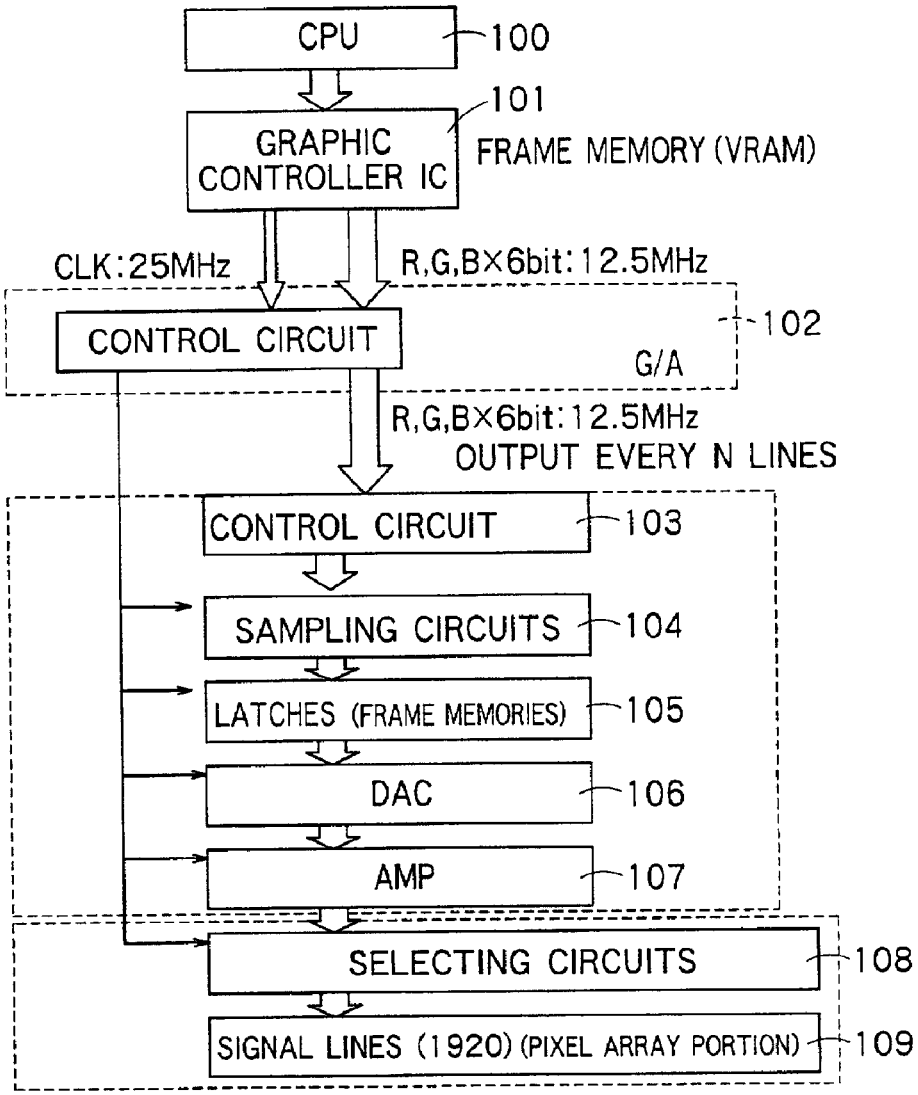
FIG. 36 is a block diagram of a conventional liquid crystal display apparatus.

Referring to FIG. 1, the graphic controller IC 5 and the control signal output unit 12 shown by thick solid lines include the function of the gate array 102 shown in FIG. 36 therein.

Hereinbelow, it is assumed that (640×3) signal lines and 480 scanning lines are arranged on the pixel array portion 1. It is also assumed that the graphic controller IC 5 supplies RGB digital data each comprising 6 bits to the signal line driving circuit 2.

Figure 3:
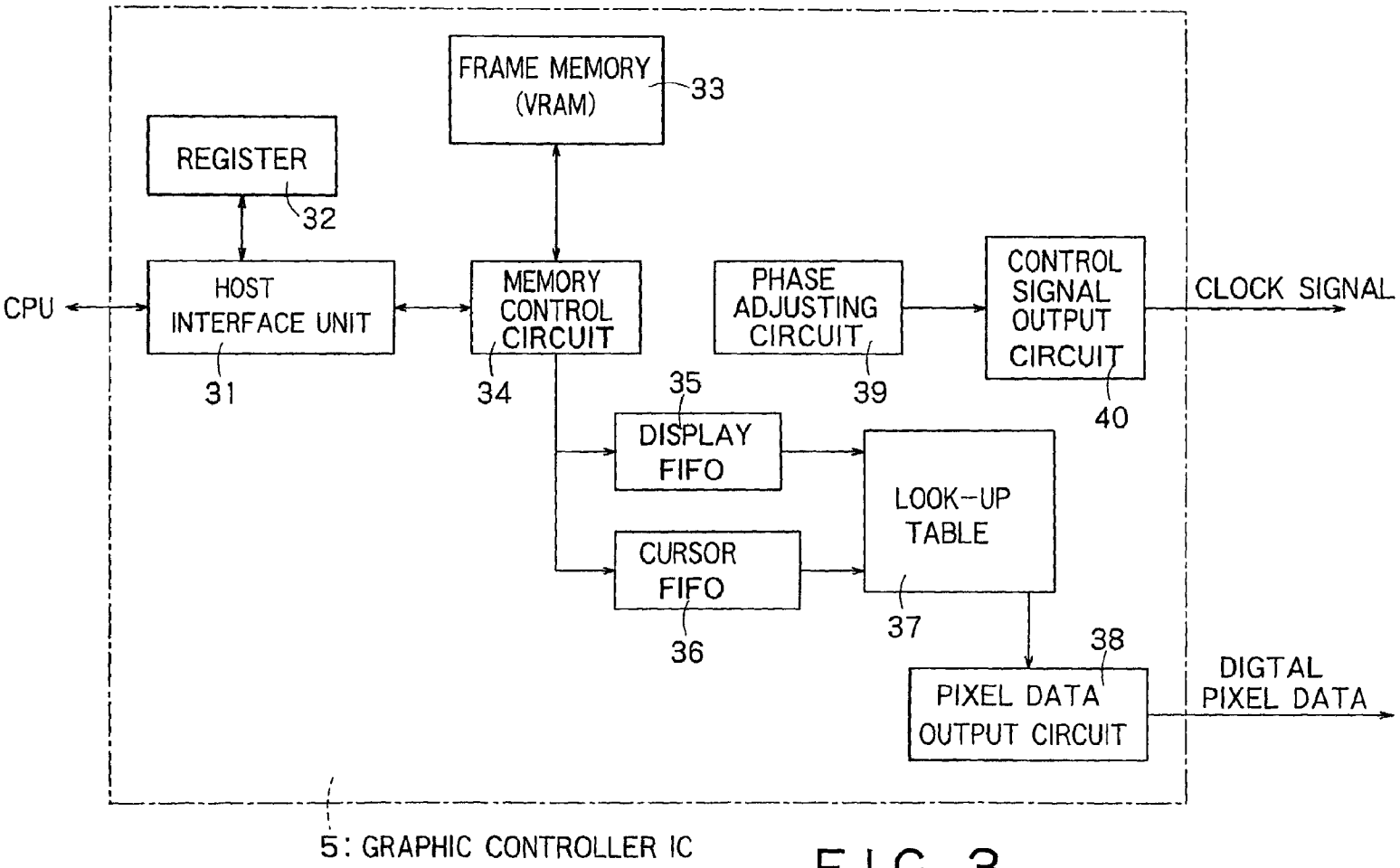
FIG. 3 is a block diagram showing the internal construction of a graphic controller IC.

Prior to the explanation regarding the construction in FIG. 1, the construction of the graphic controller IC 5 will now be described. FIG. 3 is a block diagram showing the internal construction of the graphic controller IC 5. As shown in the diagram, the graphic controller IC 5 comprises: a host interface unit 31 for receiving video data from the CPU; a register 32; a frame memory (VRAM) 33 comprised of a random memory such a DRAM or an SRAM for storing the received video data; a memory control circuit 34 for controlling the writing and reading operations for the frame memory 33; a display FIFO 35 for temporarily storing video data; a cursor FIFO 36 for temporarily storing cursor data which is displayed on the screen; a look-up table 37 for converting the video data and cursor data into RGB digital pixel data each having 6-bit gray scale; a pixel data output circuit 38 for controlling the output of the digital pixel data; a phase adjusting circuit 39 for adjusting the phase of the clock signal CLK; and a control signal output circuit 40 for controlling the output of the clock signal CLK and the synchronization signal.

The pixel data output circuit 38 sequentially outputs RGB digital pixel data each comprising 6 bits, namely, digital pixel data of 18 bits in total in a cycle of 40 ns (25 MHz). The control signal output circuit 40 outputs the clock signal CLK of 12.5 MHz and the synchronization signal. The phase of the clock signal CLK deviates from that of a video signal by an amount substantially corresponding to a half-clock signal CLK (20 ns).

Figure 4:
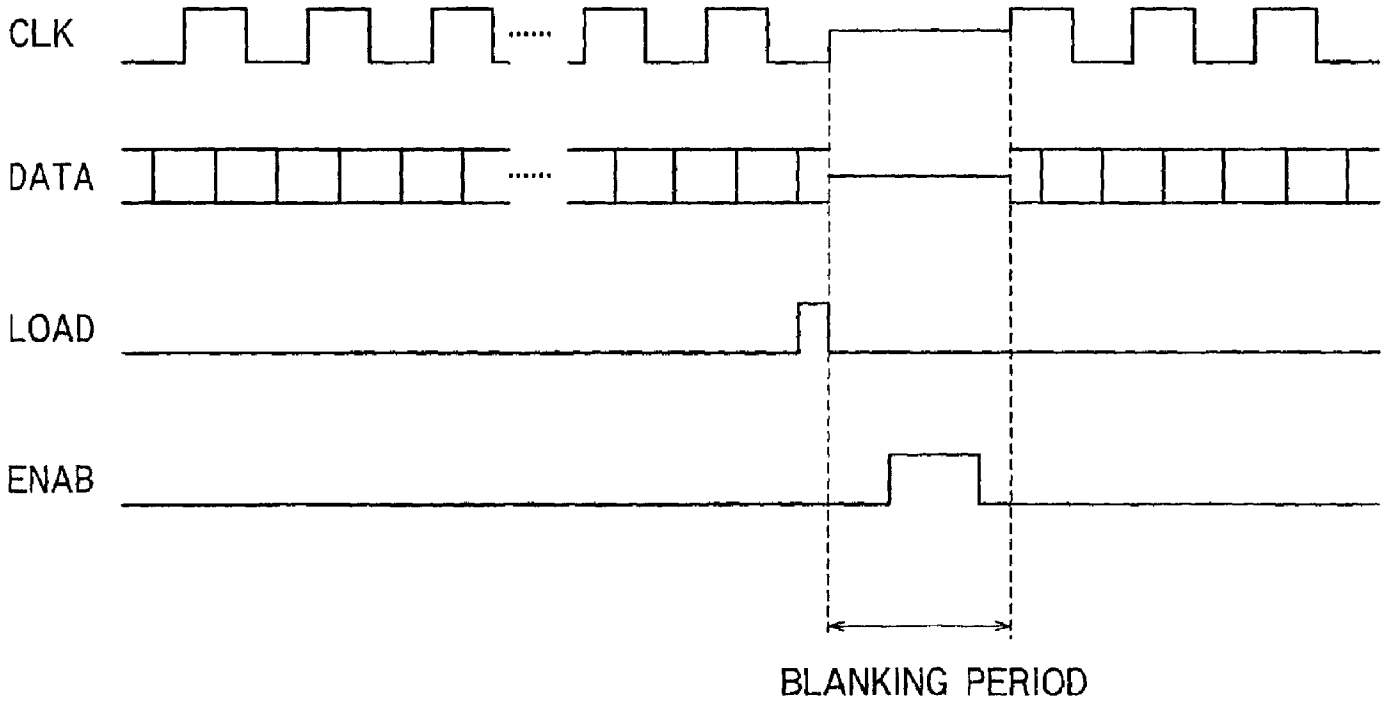
FIG. 4 is an output timing chart of the graphic controller IC.

FIG. 4 is a timing chart of outputs of the graphic controller IC 5 and shows a timing chart regarding an enable signal ENAB and the load signal L as control signals, clock signal CLK, and digital pixel data DATA.

As shown in FIG. 4, the cycle of the clock signal CLK is twice as much as that of the digital pixel data and the phase of the clock signal CLK deviates from that of the digital pixel data DATA.

As mentioned above, the cycle of the clock signal CLK is set twice or more as much as that of the digital pixel data, so that the frequency of the clock signal CLK to be supplied to the signal line driving circuit 2 can be lowered and the circuit operation of the signal line driving circuit 2 can be stabilized. The phase of the digital pixel data DATA and that of the clock signal CLK are shifted from each other, so that the digital pixel data can be surely latched on the basis of the clock signal CLK in the signal line driving circuit 2.

The phase adjusting circuit 39 in the graphic controller IC 5 adjusts the phase of the digital pixel data DATA and that of the clock signal CLK.

Figure 5:
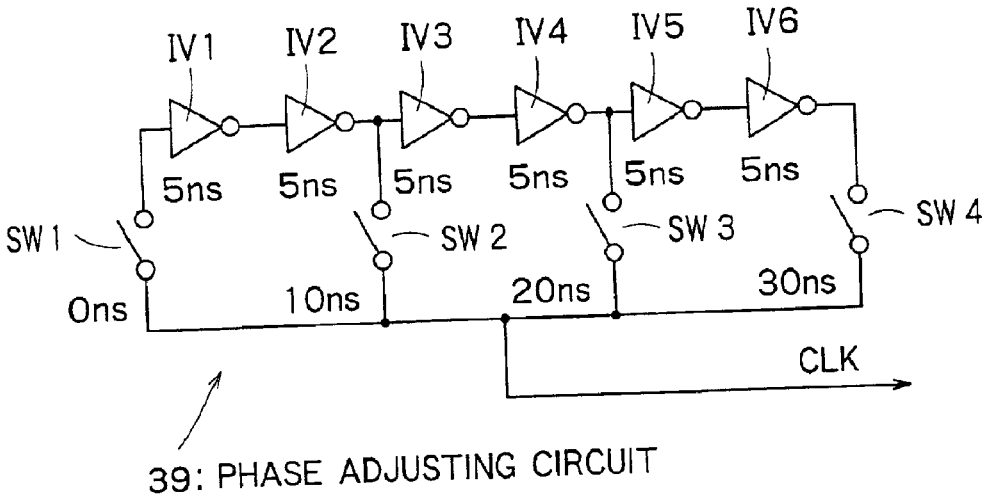
FIG. 5 is a circuit diagram of a phase adjusting circuit.

FIG. 5 is a circuit diagram of the phase adjusting circuit 39. As shown in the diagram, the phase adjusting circuit 39 is constructed by serially connecting a plurality of inverters IV1 to IV6. Output terminals of the inverters IV2, IV4, and IV6 at the even-numbered stages are coupled to switches SW1 to SW4, respectively. Any one of the switches SW1 to SW4 is turned on. In case of a CMOS-IC, since delay time per inverter stage is substantially equal to 5 ns. Accordingly, in case of the circuit of FIG. 5, the delay time can be adjusted at intervals of 10 ns.

One of the switches SW1 to SW4 can be manually switched to another one upon manufacturing. Alternatively, the signal is transmitted from the graphic controller IC 5 to the signal line driving circuit 2, alternately selecting among the switches SW1 to SW4 can be automatically performed in accordance with a period until the signal is returned.

As shown in FIG. 4, for one horizontal line period or a blanking period between one-frame periods, the control signal output circuit 40 sets the synchronization signal and clock signal CLK to an intermediate potential. At point in time when the next cycle starts, the synchronization signal and clock signal CLK can be rapidly set to a predetermined potential by setting them to the intermediate potential.

Figure 6:
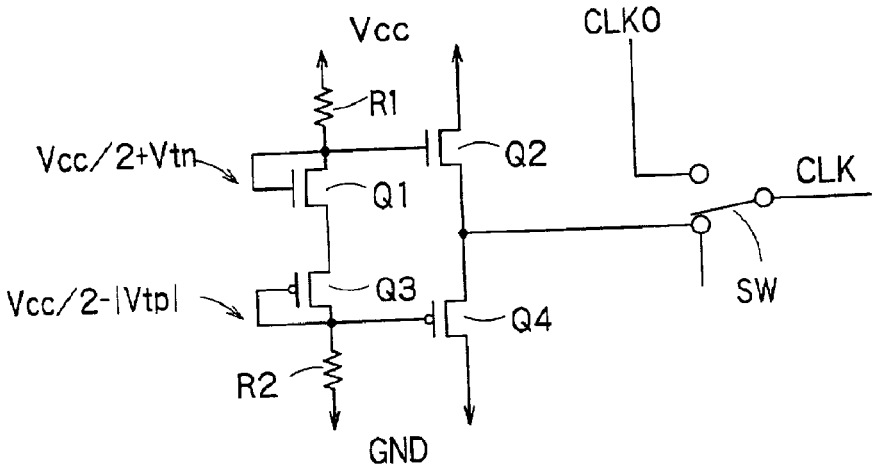
FIG. 6 is a circuit diagram of an intermediate potential setting circuit for setting a synchronization signal and a clock signal CLK to an intermediate potential.

FIG. 6 is a circuit diagram of an intermediate potential setting circuit for setting the synchronization signal and the clock signal CLK. The intermediate potential setting circuit is provided in each of the pixel data output circuit 38 and the control signal output circuit 40.

As shown in FIG. 6, the intermediate potential setting circuit includes NMOS transistors Q1 and Q2 and PMOS transistors Q3 and Q4. The NMOS transistor Q2 and PMOS transistor Q4 are serially connected between a power supply terminal and a ground terminal. A resistor element R1, the NMOS transistor Q1, PMOS transistor Q3, and a resistor element R2 are serially connected between the power supply terminal and the ground terminal.

The resistance of the resistor element R1 is equivalent to that of the resistor element R2 and they are set to an adequately high value. Thereby, a drain terminal of the NMOS transistor Q1 and a gate terminal of the NMOS transistor Q2 are equal to (Vcc/2+Vth) and a drain terminal of the PMOS transistor Q3 and a gate terminal of the PMOS transistor Q4 are equal to (Vcc/2+|Vtp|). Consequently, a current driving force of several mA can be obtained by a slight leakage through current of about several $\mu$A.

As shown in FIG. 6, an output terminal of the intermediate potential setting circuit is coupled to an analog switch SW. The analog switch SW selects the output of the intermediate potential setting circuit during the blanking period and selects a clock signal CLK0 during a period other than the blanking period.

FIG. 6 illustrates the case in which the clock signal CLK is set to the intermediate potential. The digital pixel data DATA is also set to the intermediate potential during the blanking period by the same circuit as that of FIG. 6.

The graphic controller IC 5 according to the present embodiment rearranges the digital pixel data DATA supplied from the CPU and outputs the resultant data. Hitherto, as shown in FIG. 36, the line memory is provided in the gate array 102 which is arranged separately from the graphic controller IC 5, and rearranging data is performed in the memory. This is because the general versatility of the graphic controller IC 5 is raised and the graphic controller IC can be used in common in other active matrix display apparatuses using not only the polysilicon TFT but also an amorphous silicon TFT or an MIM.

On the other hand, according to the present embodiment, the graphic controller IC 5 includes the frame memory 33 (VRAM) having a large capacity of hundreds of KB to several MB. Since it is determined from the view point of the gate scale that data can be easily rearranged by using a part of the memory, the rearranging operation is performed in the graphic controller IC 5.

Figure 7:
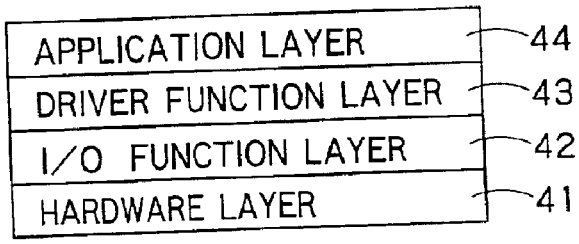
FIG. 7 is a diagram showing the internal construction of a memory control circuit for controlling a frame memory.

FIG. 7 is a diagram showing the internal construction of the memory control circuit 34 for controlling the frame memory 33. As shown in the diagram, the memory control circuit 34 includes a hardware layer 41 as a bottom layer, an I/O function layer 42 thereon, a driver function layer 43 thereon, and an application layer 44 as a top layer.

The hardware layer 41 is a portion to actually make access to the frame memory 33. The I/O function layer 42 is a portion to rewrite a port or an internal register in the hardware layer 41, thereby switching the method for accessing the frame memory 33 to another one. The driver function layer 43 is a portion to realize various functions such as initialization of the screen, display control of the screen, rectangle drawing, and bit map drawing by directly invoking from the application layer 44 as an upper layer. The application layer 44 is a portion to issue various commands for image display.

The I/O function layer 42 and the driver function layer 43 are formed by a program language such as a C language. Drawing to a specific area of the screen is written by using an address format on the look-up table 37 in which the coordinates (x, y) of the frame memory 33 =color information have been stored. Reading data from the frame memory 33 is also performed by using the array.

Figure 8:
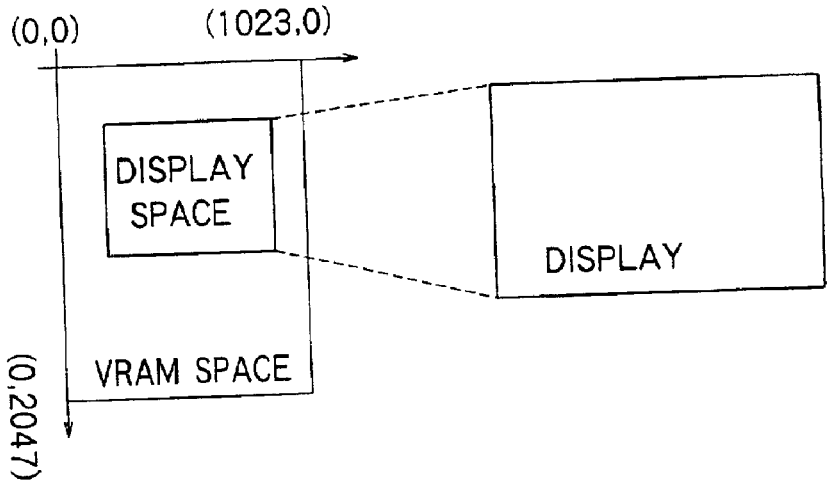
FIG. 8 is a diagram showing a relation between a VRAM space and a display space.

As shown in FIG. 8, a memory space (VRAM space) of the frame memory (VRAM) 33 has an area larger than or equivalent to one screen. An arbitrary area in the VRAM can be displayed on the screen by controlling a pointer of the VRAM in the driver function layer. As mentioned above, the memory space of the VRAM is provided so as to be larger than or equivalent to one screen, so that scrolling or switching the screen can be rapidly performed.

As mentioned above, since the graphic controller IC 5 according to the present embodiment performs order control the digital pixel data DATA in the inside, it is unnecessary to provide the gate array. Since the cycle of the clock signal CLK is set twice or more as much as that of the digital pixel data DATA, the clock signal CLK having a frequency, at which the polysilicon TFT normally operates, can be supplied to the signal line driving circuit 2.

Further, since the edge of the clock signal CLK is shifted from the changing position of the digital pixel data DATA and they are outputted, the signal line driving circuit 2 can surely capture the digital pixel data DATA.

Figure 9:
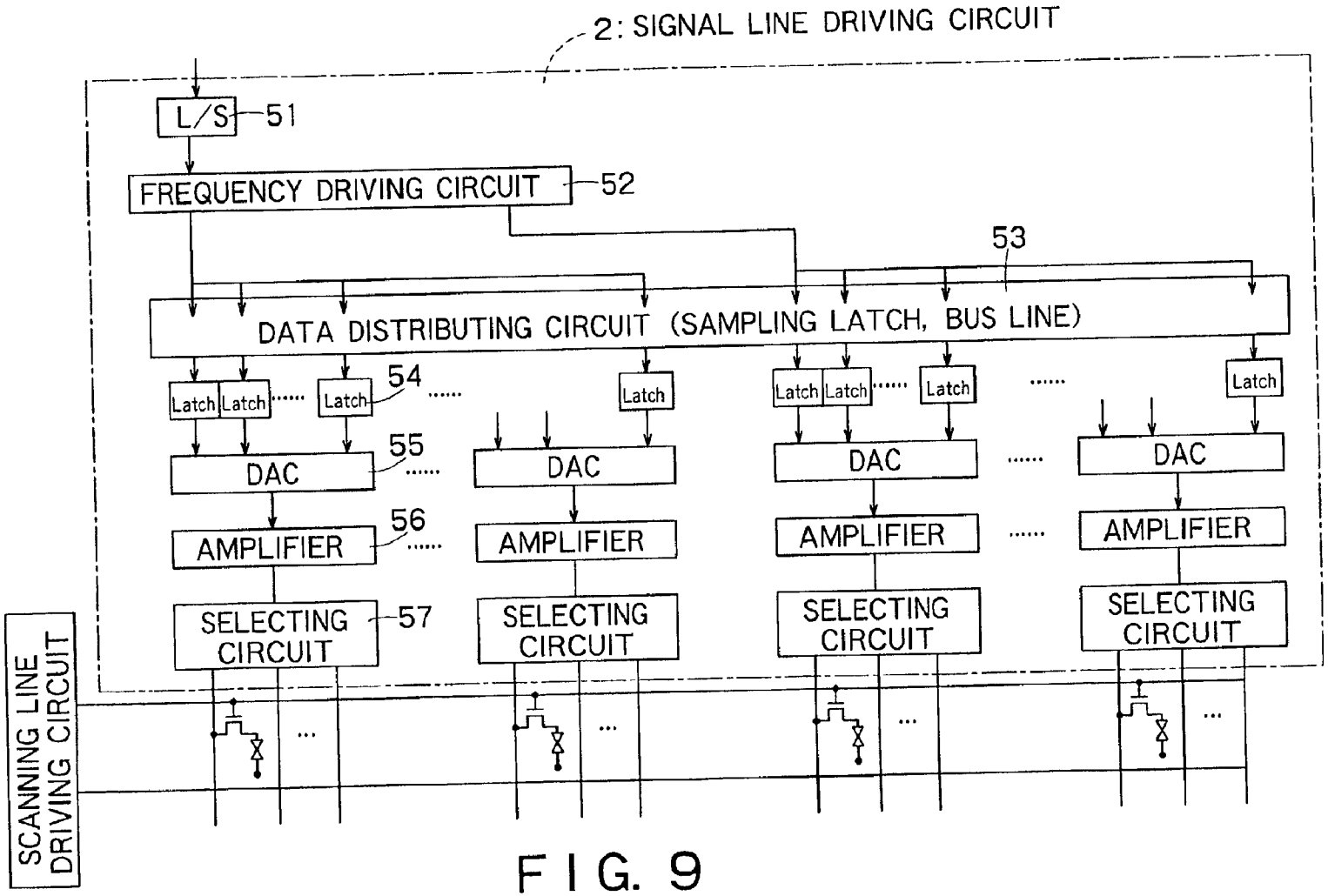
FIG. 9 is a block diagram showing the internal construction of a signal line driving circuit.

FIG. 9 is a block diagram of the detail of the signal line driving circuit 2 according to the present embodiment. As shown in the diagram, the signal line driving circuit 2 comprises: a level shifter (L/S) 51, a frequency dividing circuit 52 for doubling the cycle of the digital pixel data DATA; data distributing circuits 53 for outputting the serially arranged digital pixel data DATA in parallel; latch circuits (Latches) 54 for latching the distributed digital pixel data DATA in a lump; D/A converters (DAC's) 55 for converting the latched digital pixel data DATA to an analog voltage; amplifiers (AMP's) 56 for adjusting the gain of the analog voltage; and selection circuits 57 for selecting an analog pixel voltage outputted from the amplifier 56 and supplying the selected voltage to respective signal lines.

Figure 10:
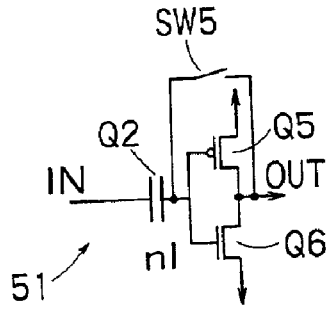
FIG. 10 is a circuit diagram of a level shifter.
Figure 11:
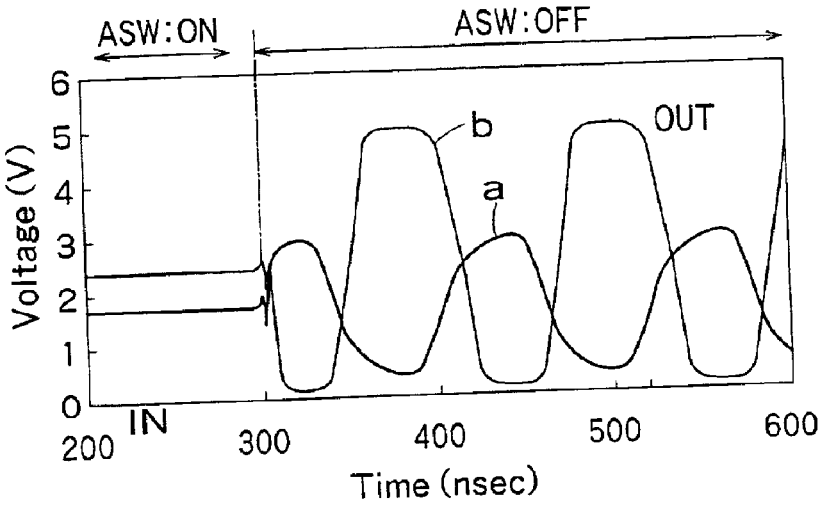
FIG. 11 is a waveform diagram of input/output signals of the level shifter.

FIG. 10 is a circuit diagram of the level shifter 51 and FIG. 11 is a waveform diagram of input/output signals to/from the level sifter 51. A thick curve a in FIG. 11 denotes the input signal and a thin curve b indicates the output signal. As shown in FIG. 10, the level shifter 51 comprises: a capacitor element Cl; a PMOS transistor Q5 and an NMOS transistor Q6 constituting an inverter; and an analog switch SW5.

The analog switch SW5 in the level shifter 51 is turned on when the digital pixel data DATA supplied from the graphic controller IC 5 is at the intermediate potential (1.65V) during the blanking period. Consequently, a voltage of one end b of the capacitor element C1 is equivalent to a threshold voltage (about 2.5V) of the inverter and a voltage of (2.5V–1.65V=) 0.85V is applied across the capacitor element C1.

When the analog switch SW5 is turned off, the digital pixel data DATA supplied from the graphic controller IC 5 is offset-adjusted as much as the voltage of 0.85V across the capacitor element C1, namely, 0.85V, and then transmitted. That is, a voltage fluctuating on the threshold voltage of the inverter vertically as much as only the same level is applied to a gate terminal of each of the PMOS transistor Q5 and the NMOS transistor Q6 constituting the inverter.

As mentioned above, since the input is symmetrized to the threshold voltage of the inverter, even when the threshold value of the polysilicon TFT is varied, the characteristics of the PMOS transistor Q5 and NMOS transistor Q6 get out of balance, or the amplitude of the input becomes dull, the inverter operates at a high speed and the pulse width is hard to change.

Figure 12:
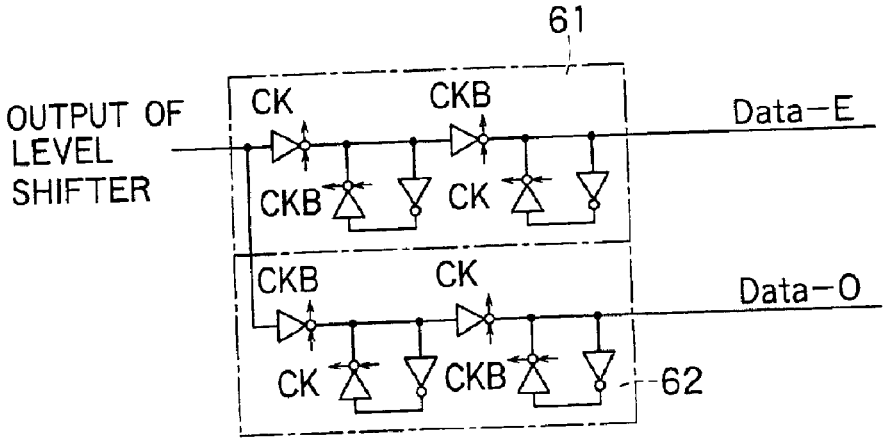
FIG. 12 is a circuit diagram of a frequency dividing circuit.

FIG. 12 is a circuit diagram of the frequency dividing circuit 52. As shown in the diagram, the frequency dividing circuit 52 comprises two latch circuits 61 and 62 for outputting the digital pixel data DATA in phase at a data width corresponding to two cycles of the clock signal CLK. Each latch circuit has a clocked inverter and an inverter.

Figure 13:
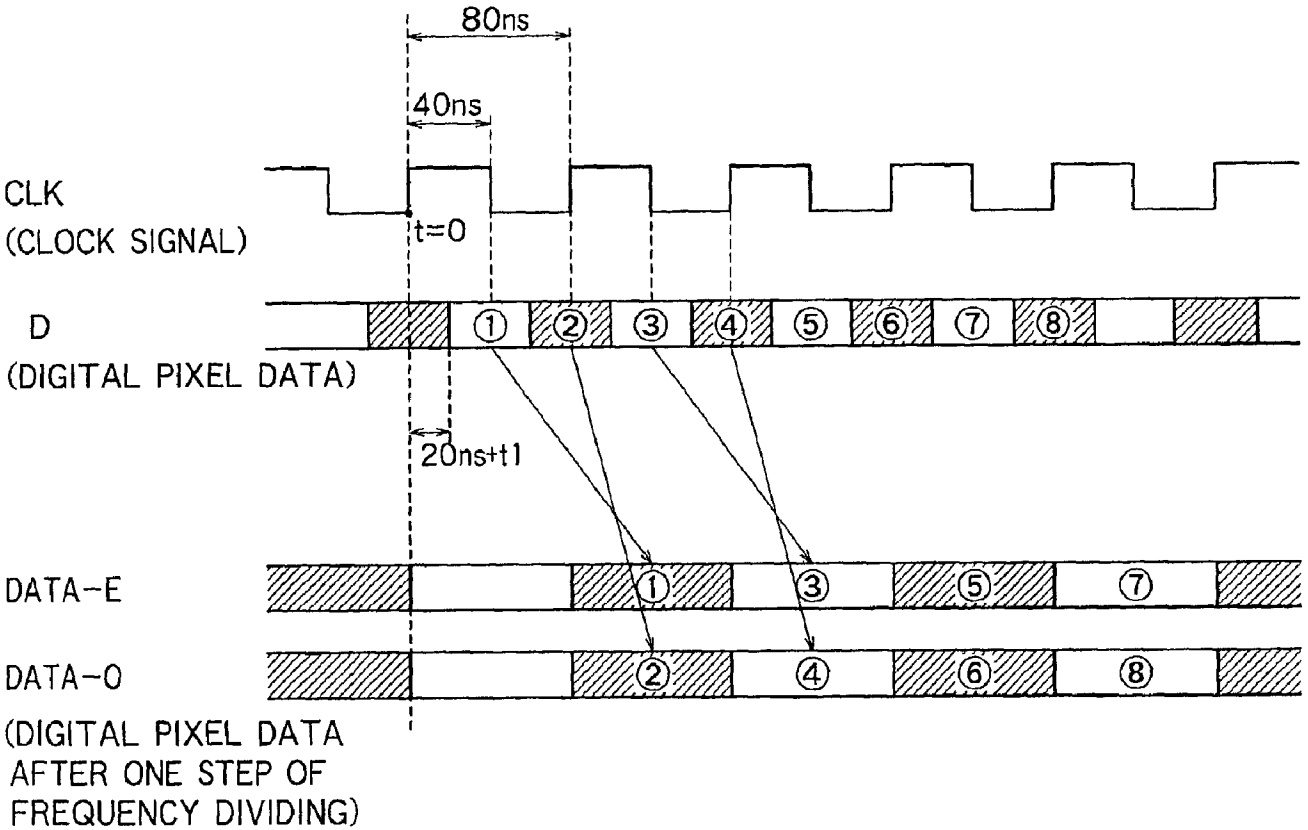
FIG. 13 is an output timing chart of latch circuits in the frequency dividing circuit.

FIG. 13 shows the timing of an output DATA-E and that of an output DATA-O of the respective latch circuits in the frequency dividing circuit 52. Referring to FIG. 13, the digital pixel data DATA outputted from the graphic controller IC 5 is shown by reference numerals (1), (2), (3), . . .

As shown in FIG. 13, the latch circuits 61 and 62 latch the digital pixel data DATA every other data, respectively, and output the data at the same timing. Outputs of the frequency dividing circuit 52 are inputted to the data distributing circuits 53. The latch circuit 61 latches data at the falling edge of a positive-phase clock. The latch circuit 62 latches data at the falling edge of a reversed-phase clock. To maintain a latch margin, preferably, not only the timing of the positive-phase clock but also the timing of the reversed-phase clock are adjusted by the graphic controller IC 5.

The present embodiment has such characteristics that each signal line is driven separating from each color, instead of simultaneously driving all the signal lines. In this manner, the number of latch circuits 54 and the number of D/A converters 55 in the signal line driving circuit 2 can be reduced.

The data distributing circuits 53 sequentially latch the digital pixel data DATA outputted from the frequency dividing circuit 52 to distribute the data in parallel. A plurality of data, which have been latched so as to divert the timing by the data distributing circuits 53, are re-latched by the latch circuits 54 at the same timing. The re-latched data is inputted to each D/A converter 55 and is converted to an analog voltage. After that, the voltage is amplified by each amplifier 56 and then the amplified voltage is written into the corresponding signal line and signal.

Figure 14:
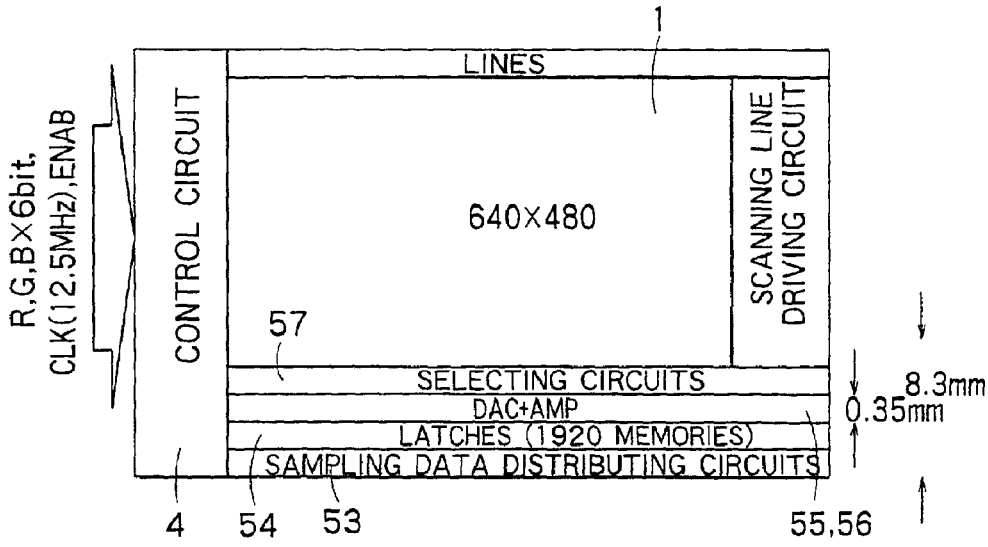
FIG. 14 is a diagram of layout on a glass substrate of the display apparatus of the present embodiment.
Figure 15:
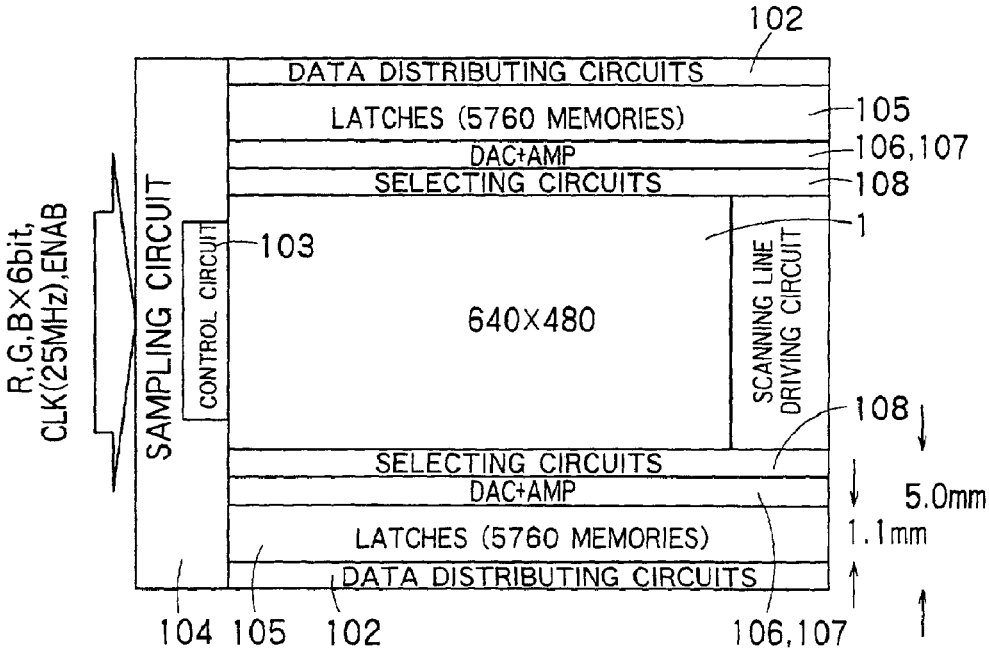
FIG. 15 is a diagram of the chip layout of a conventional display apparatus constructed by using a general-purpose graphic controller IC.

FIG. 14 is a diagram showing the layout on the glass substrate 10 of the display apparatus of the present embodiment. FIG. 15 is a diagram showing the chip layout of the conventional display apparatus constructed by using the general-purpose graphic controller IC.

The general-purpose graphic controller IC generates digital pixel data, which is outputted in the normal order, and a clock signal whose cycle corresponds to the width of pixel data. According to a design rule of line/space=4 μm/4 μm or so, it is difficult to form a D/A converter for each signal line. The D/A converter must be provided every plural signal lines. In this case, it is necessary to temporarily latch the pixel data inputted in the normal order as much as one horizontal period and rearrange the data in desired order.

In case of FIG. 15, since it is necessary to rearrange the digital pixel data on the glass substrate 10, it is necessary to provide a latch (memory) circuit of one line, so that the number of latch circuits is increased by six times. Accordingly, it is necessary to provide two sets each including the data distributing circuit 102, D/A converters 106, amplifiers 107, and selecting circuits 108 in the upper and lower portions, respectively.

As mentioned above, when the digital pixel data DATA are rearranged in the graphic controller IC 5 as in the present embodiment, the circuitry on the glass substrate 10 can be simplified, so that a space to mount the graphic controller IC 5 on the glass substrate 10 can be easily obtained.

FIG. 1 illustrates the number of gates in the respective sections when the liquid crystal display apparatus using the RGB 6-bit data in VGA standard (640×480 dots) is constructed by utilizing the present embodiment. FIG. 1 shows the case in which the signal lines are drive every six lines.

In the case of FIG. 1, six level shifters 51 for each color, namely, 18 level shifters in total, six frequency dividing circuits 52 for each color, namely, 18 circuits in total, 640 sampling circuits 53 and 640 latch circuits 54 for each color, namely, 1920 sampling circuits and 1920 latch circuits in total, and 320 D/A converters 55 and 320 amplifiers 56 are required, respectively. Consequently, 1K gates are needed for the control circuit, 1K gates are needed for the frequency dividing circuits 52, 13K gates are needed for the sampling circuits and latch circuits 54, and 5K gates are necessary for the D/A converters 55, the amplifiers 56 and selecting circuit 57.

As mentioned above, according to the present embodiment, the circuit scale can be remarkably reduced as compared with that of the conventional one as much as the portion corresponding to the unnecessary gate array and the portion corresponding to the sampling circuits 53 and latch circuits 54 deleted by driving the signal lines every N lines (N is an arbitrary integer that is equal to or larger than 2).

FIGS. 14 and 15 show the schematic size of a chip. In the case of the present embodiment, the length of an area to form the driving circuit in the longitudinal direction is equal to about 8.3 mm. On the other hand, in the conventional construction shown in FIG. 15, the length of the area to form the driving circuit in the longitudinal direction is equal to about (5.0 mm×2=) 10 mm, so that the forming area of the driving circuit according to the present embodiment is smaller than that of the conventional one.

In the above-mentioned embodiment, although the cycle of the digital pixel data DATA outputted from the graphic controller IC 5 is set twice as much as that of the clock signal CLK, the cycle can be set to a cycle longer than the doubled cycle. The frequency of the clock signal CLK transmitted from the graphic controller IC 5 to the signal line driving circuit 2 may have a value other than 12.5 MHz. Further, the kind of signal outputted from the above-mentioned graphic controller IC 5 is not especially limited.

The level shifters 51 may have constitution other than that shown in FIG. 10. When the level shifters 51 have constitution other than that shown in FIG. 10, it is unnecessary to set the clock signal CLK and the digital pixel data DATA to the intermediate voltage during the blanking period as shown in FIG. 4.

In the above-mentioned embodiment, the liquid crystal display apparatus as an example of the display apparatuses has been described. The present invention can be also applied to another display apparatus (for example, a plasma display apparatus) in which the signal lines and scanning lines are arranged laterally and longitudinally.

Further, in the above-mentioned embodiment, the display resolution of the VGA standard (640×480 dots) has been described as an example, the display resolution is not especially limited.

Second Embodiment

According to a second embodiment, there is provided an apparatus intended for a reduction in power consumption by arranging data buses from substantially the center in the lateral direction of an EL panel portion toward both the ends thereof.

Figure 16:
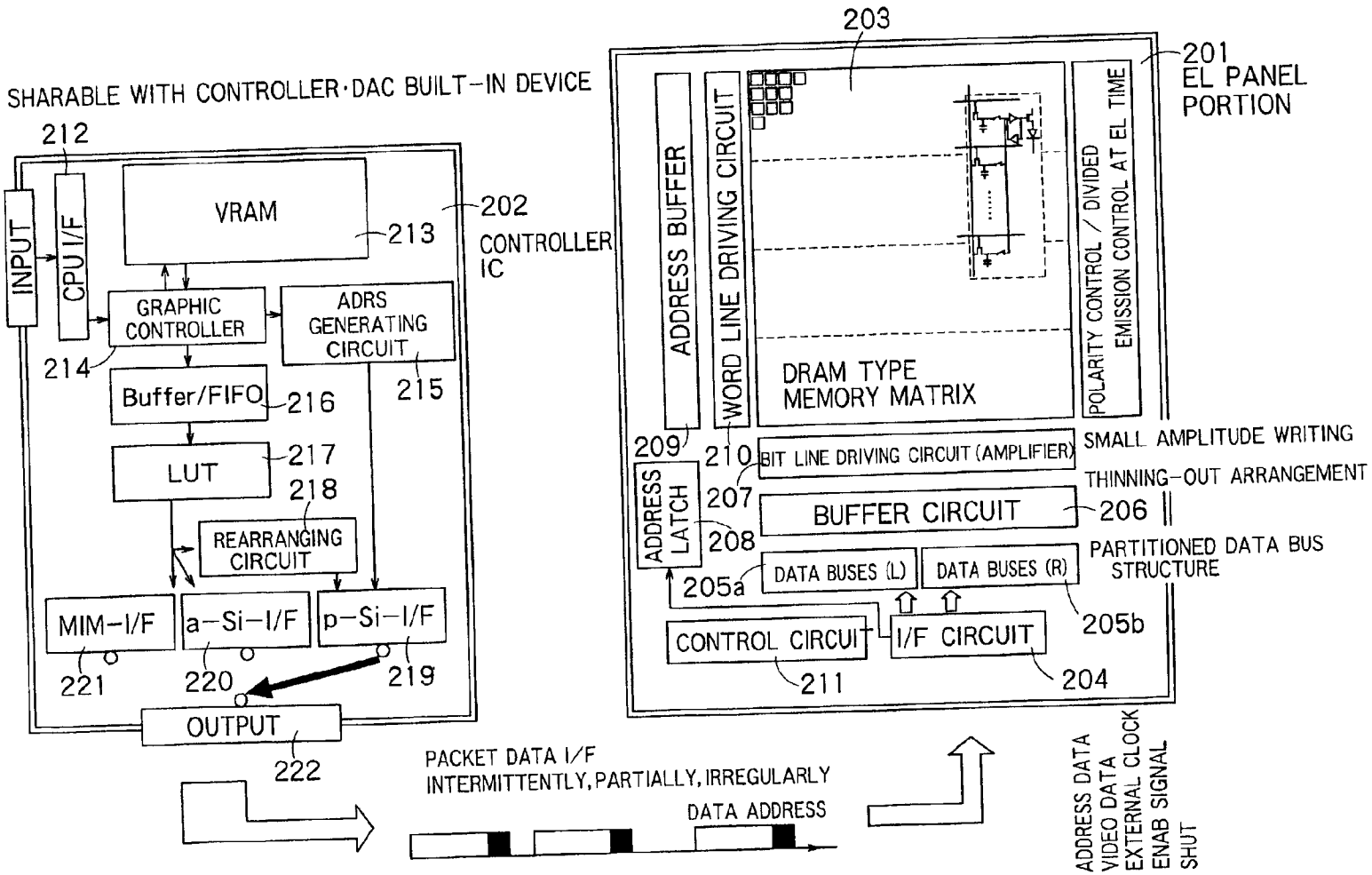
FIG. 16 is a block diagram of a display apparatus of a second embodiment according to the present invention.

FIG. 16 is a block diagram of a display apparatus of the second embodiment according to the present invention. The display apparatus in FIG. 16 has an EL panel portion 201 formed on a glass substrate and a controller IC 202 mounted on the glass substrate or another substrate.

The EL panel portion 201 comprises: a pixel array portion 203 in which the display gray scale luminance of the pixel can be controlled on the basis of a memory comprising a plurality of bits provided for each pixel; an I/F circuit 204 for transmitting and receiving signals to/from the controller IC 202; data buses 205*a* and 205*b* arranged from substantially the center in the lateral direction of the pixel array portion 203 toward both the ends thereof; a buffer circuit 206 for buffering digital pixel data on the data buses 205*a* and 205*b*; a bit line driving circuit 207 for driving respective bit lines in the pixel array portion 203; an address latch circuit 208 for latching an address signal from the I/F circuit 204; an address buffer 209 for buffering the latched address signal; a word line driving circuit 210 for driving respective word lines in the pixel array portion 203; and a control circuit 211 for controlling the respective circuits.

The controller IC 202 comprises: a CPU-I/F unit 212 for communicating with a CPU; a display memory (VRAM) 213; a graphic controller 214; an address generating circuit 215 for designating an address in the pixel array portion 203; a buffer/FIFO 216 for buffering and temporarily storing the digital pixel data; a look-up table (LUT) 217 for converting data; a rearranging circuit 218 for rearranging the digital pixel data; an I/F unit (p-Si-I/F unit) 219 for a polysilicon TFT; an I/F unit 220 for an amorphous silicon TFT; an I/F unit (MIM-I/F unit) 221 for MIM; and an output unit 222. Since the controller is constructed as mentioned above, it can be connected to an a-Si TFT active matrix LCD, an MIM active matrix LCD, and a poly-Si display apparatus, so that the general versatility of the graphic controller is widened.

The controller IC 202 in FIG. 16 can update the whole display in the pixel array portion 203. In addition, it can perform intermittent display update, partial display update, and irregular display update.

Figure 17:
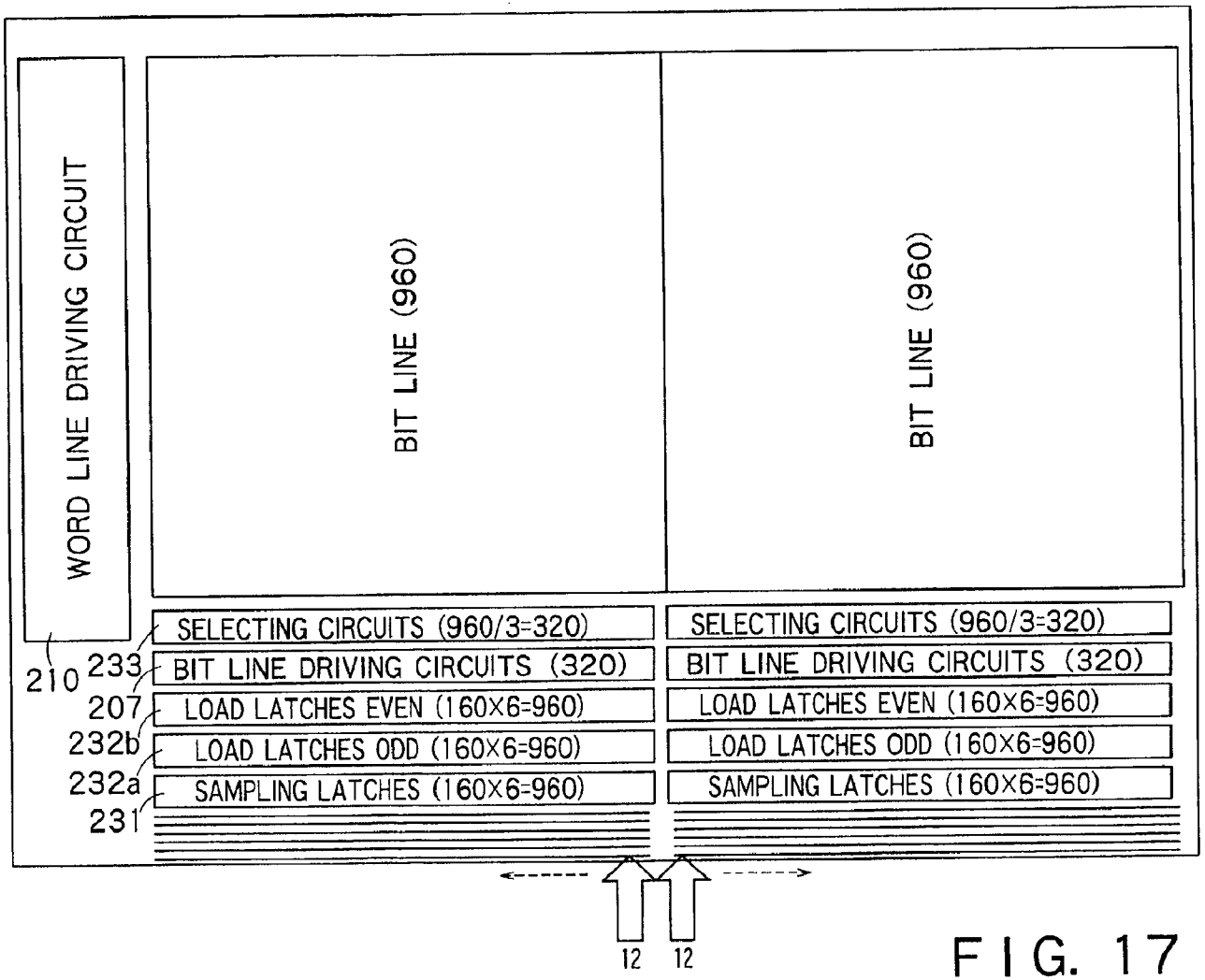
FIG. 17 is a diagram showing the arrangement of data buses.

FIG. 17 is a diagram showing the arrangement of the data buses 205*a* and 205*b*. As shown in the diagram, the data buses 205*a* and 205*b* are arranged along the lower side of the glass substrate. The digital pixel data is inputted in the direction shown by thick arrows in the diagram and the digital pixel data is propagated along dotted arrows. In the following description, it is assumed that each of the RGB digital pixel data consists of 6 bits.

FIG. 17 illustrates a case in which 960 bit lines are arranged from the center of the pixel array portion 203 to each of the right and left areas, and the bit lines are driven every three lines. That is, the number of bit lines simultaneously driven is (960/3=) 320. In this case, load latches corresponding to (320×6) bits are needed for each half of the screen. Sampling latches are provided by an amount corresponding to (160×6) bits that is half of the number of load latches.

Figure 19:
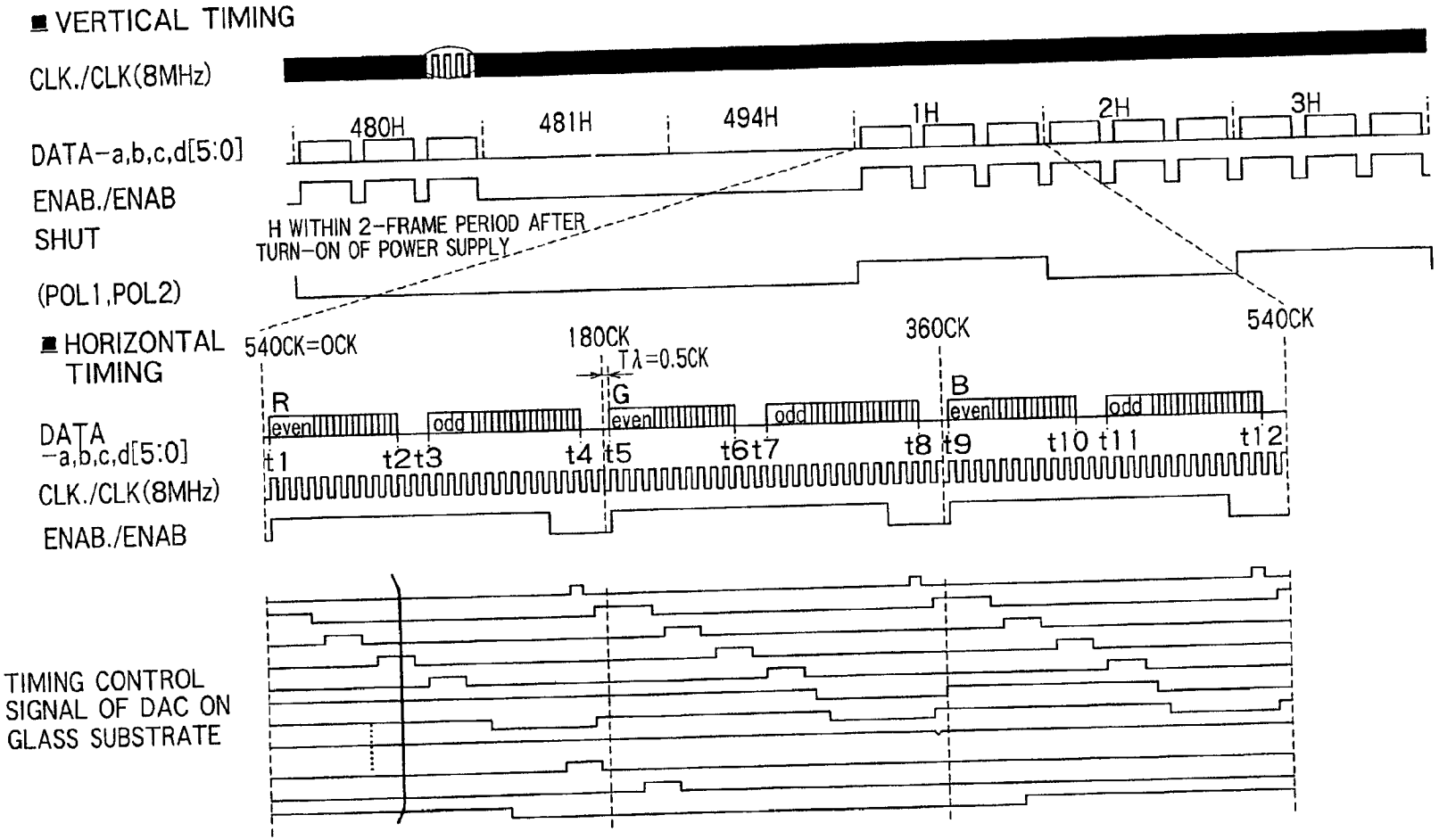
FIG. 19 is a timing chart of the display apparatus of FIG. 16.

FIG. 18 is a diagram showing the arranging order of data on the data buses 205*a* and 205*b*. FIG. 19 is a timing chart of the display apparatus in FIG. 16. As shown in the diagram, red odd pixel data of two pixels is transmitted to the data buses 205*a* and 205*b* so as to be distributed to the right and left thereof (time t1 to t2 in FIG. 19). Specifically, first, data R1 and R3 are transmitted to the left data buses 205*a* and 205*b* and data R637 and R639 are transmitted to the right data buses 205*a* and 205*b*, simultaneously. Subsequently, data R5 and R7 are transmitted to the left data buses 205*a* and 205*b* and data R633 and R635 are transmitted to the right data buses 205*a* and 205*b*, simultaneously. In this manner, sampling latches 231 sequentially perform latching every data of four pixels (in total, 4×6 bits=24 bits).

At point in time when the sampling latches 231 complete the latching of all the red odd pixel data (at time t2 in FIG. 19), load latches 232*a* simultaneously latch all of the data during a small data blanking period between t2 and t3.

After that, red even pixel data of two pixels is transmitted to the data buses 205*a* and 205*b* so as to be distributed to the right and left thereof (time t3 to t4 in FIG. 19). Specifically, first, data R2 and R4 are transmitted to the left data buses 205*a* and 205*b* and R638 and R640 are transmitted to the right data buses 205*a* and 205*b*, simultaneously. Subsequently, data R6 and R8 are transmitted to the left data buses 205*a* and 205*b* and data R634 and R636 are transmitted to the right data buses 205*a* and 205*b*, simultaneously. In this manner, the sampling latches 231 sequentially perform the latching every data of four pixels (in total, 4×6 bits=24 bits).

Due to such an effect that the blanking period is set between the R odd data and R even data, the sampling latches can be used repetitively twice, so that the number of sampling latches can be reduced to a value corresponding to the half of the number of load latches. In this example, the R data is divided into two groups of odd data and even data and the number of sampling latches can be reduced in half. If expanded, the R data is divided into "a group in which when the data is divided by three, the remainder is one, a group in which the remainder is two, and a group in which the remainder is three", a small blanking period is formed among data periods, and the sampling latches are used repetitively three times. Consequently, the number of sampling latches can be reduced to a value corresponding to ⅓ of the number of load latches.

At point in time when the sampling latches 231 complete the latching of all the red odd and even pixel data (time t4 in FIG. 19), the load latches 232*b* simultaneously latch all the data.

After the load latches 232*a* and 232*b* simultaneously capture the latched data and amplify the voltages, the bit line driving circuits 207 supply the data to selecting circuits 233. The selecting circuits 233 supply the data from the bit line driving circuits 207 to bit lines corresponding to the red in the right and left areas.

After that, green odd data and even data are sequentially latched by the load latches 232. Subsequently, all of the green data are simultaneously transmitted to the bit line driving circuits 207, thereby being converted to analog pixel voltages (time t5 to t8 in FIG. 19).

After that, blue odd data and even data are sequentially latched by the load latches 232. Then, all of the blue data are simultaneously transmitted to the bit line driving circuits 207, thereby being converted to analog pixel voltages (time t9 to t12 in FIG. 19).

As mentioned above, according to the present embodiment, since the data buses 205*a* and 205*b* are arranged from the center of the pixel array portion 203 to both the ends thereof, respectively, the line length of each of the data buses 205*a* and 205*b* can be shortened, so that the driving load of each data bus can be reduced. The reduced load is equivalent to a half of the load in the case where the data bus is extended from the left end to the right end of the screen. Since the bus driving power consumption is expressed by (bus driving load×frequency×voltage amplitude)$^2$, it is effective in the viewpoint of the power consumption.

Since the data of each color is divided into the odd data and even data and then latched by the load latches 232 and the bit lines are driven every color, the number of bit line driving circuits 207 can be extremely reduced, so that a reduction in occupied circuit area and a reduction in power consumption can be realized.

In FIGS. 17 to 19, the example of driving the bit lines every three lines has been described. The number of bit lines every which driving is made is not especially limited.

Figure 20A:
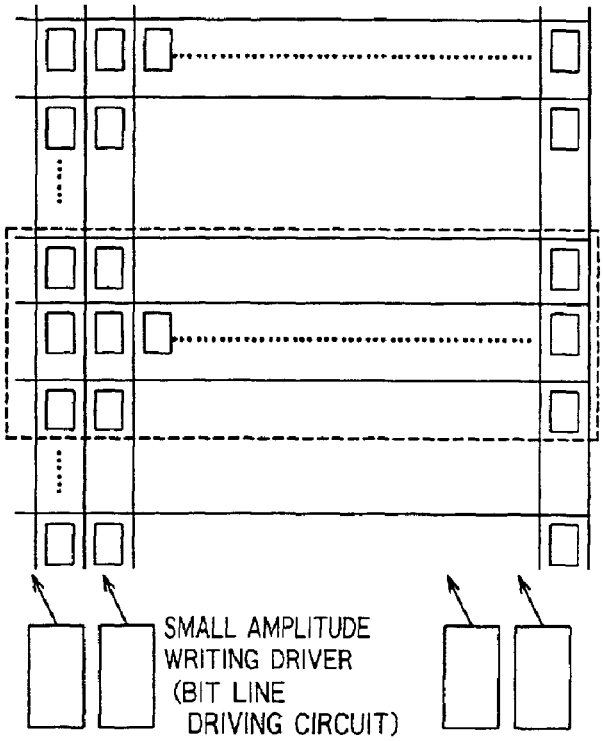
FIGS. 20A and 20B are diagrams showing examples of partial update display.

In the above-mentioned embodiment, the example regarding the display update of data in the whole area of the pixel array portion 203 has been described. As shown in FIG. 20A, display update for only some of rows or columns may be performed. Alternatively, as shown in FIG. 20B, display update for an arbitrary block alone can be performed.

Figure 20B:
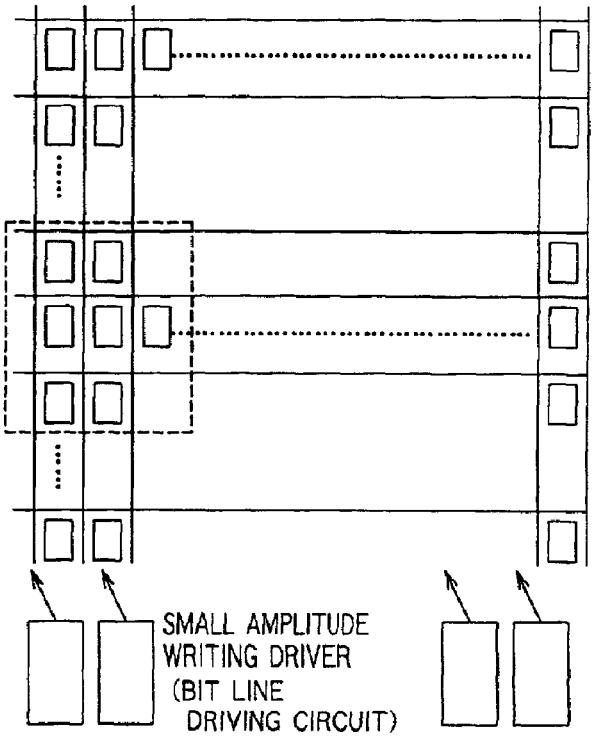

In both the cases in FIGS. 20A and 20B, it is sufficient that in the area alone in which the display update is performed, the rearranging circuit in FIG. 16 rearranges data and the address generating circuit 215 generates addresses of the area in which the display update is performed.

Figure 21:
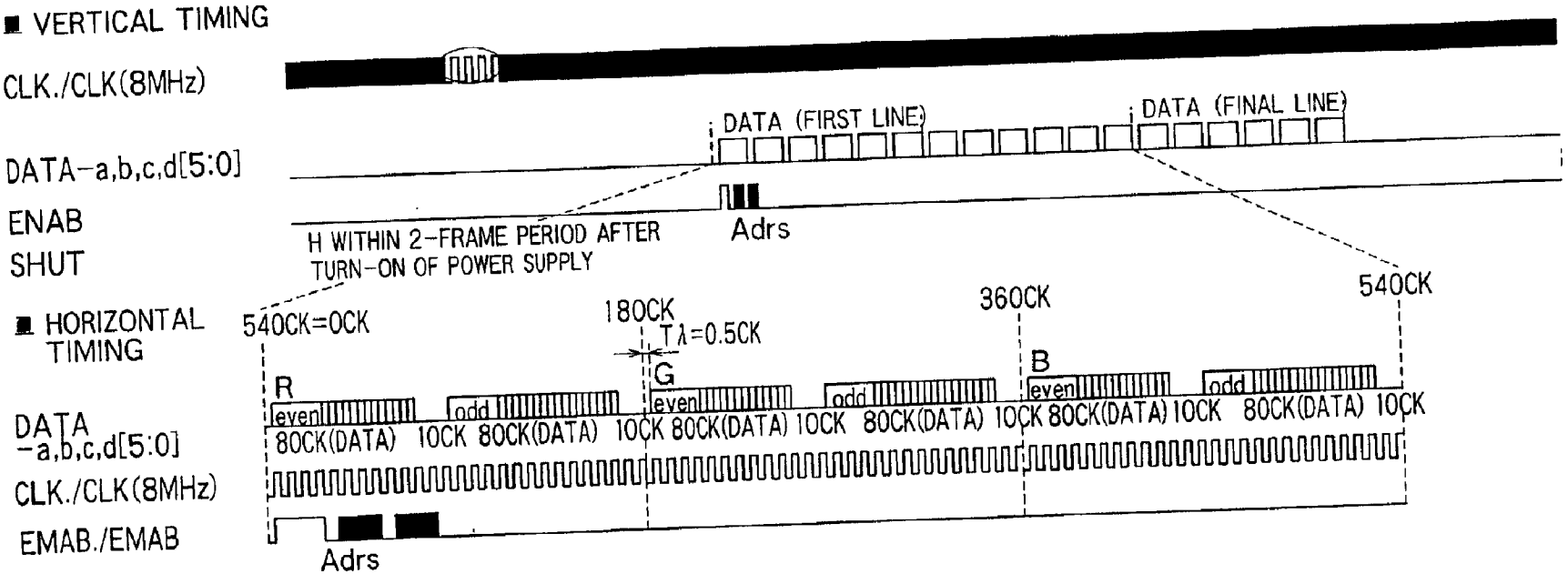
FIG. 21 is a diagram showing timing at which an address generating circuit generates an address.
Figure 22:
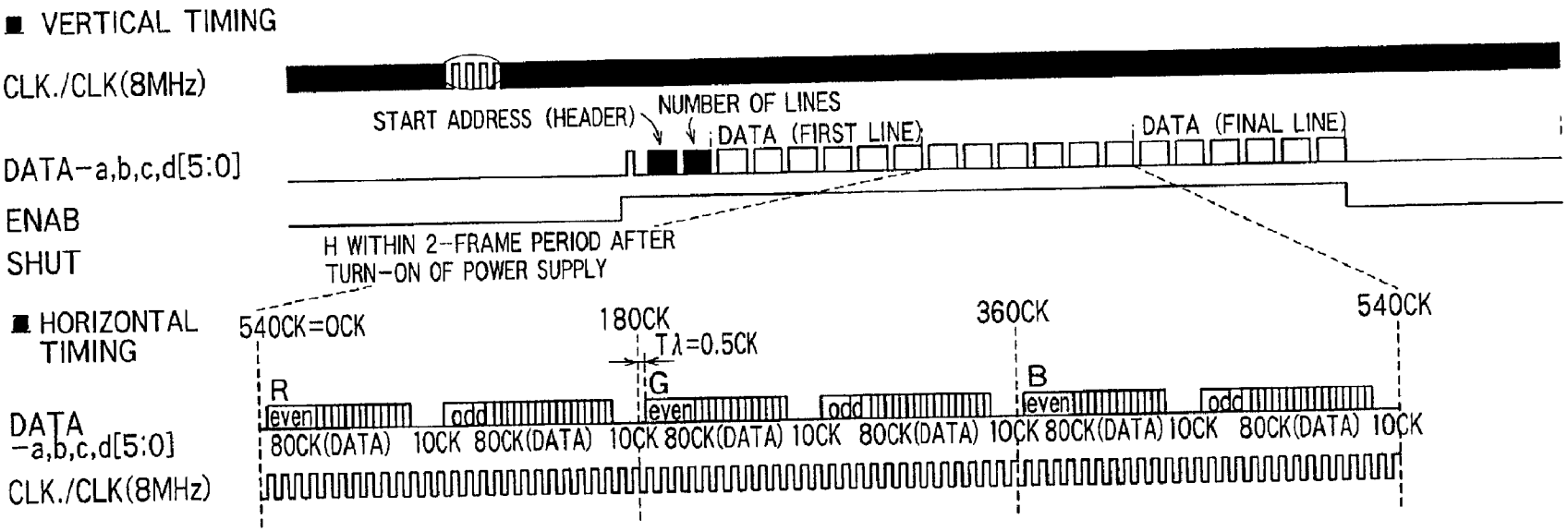
FIG. 22 is a diagram showing timing at which the address generating circuit generates the address.

FIGS. 21 and 22 are diagrams showing timing when the address generating circuit 215 generates addresses. FIG. 21 shows a case in which the addresses generated by the address generating circuit 215 are serially transmitted by using an enable terminal ENAB when the head data of the digital pixel data is supplied to the data buses 205*a* and 205*b*. Referring to FIG. 22, prior to the transmission of the digital pixel data to the data buses 205*a* and 205*b*, address information such as a start address, the number of rows, and the like can be transmitted by using the data buses 205*a* and 205*b*. The address can be transmitted by using either one of cases in FIGS. 21 and 22.

In the above-mentioned embodiment, the apparatus having the pixel array portion 203 having a DRAM structure has been explained as an example. Also in case of driving the EL panel portion 201 having the active matrix type pixel array portion 203 in which the TFT's are formed near respective points of intersection of the arranged signal lines and scanning lines, the invention can be similarly applied.

Figure 23:
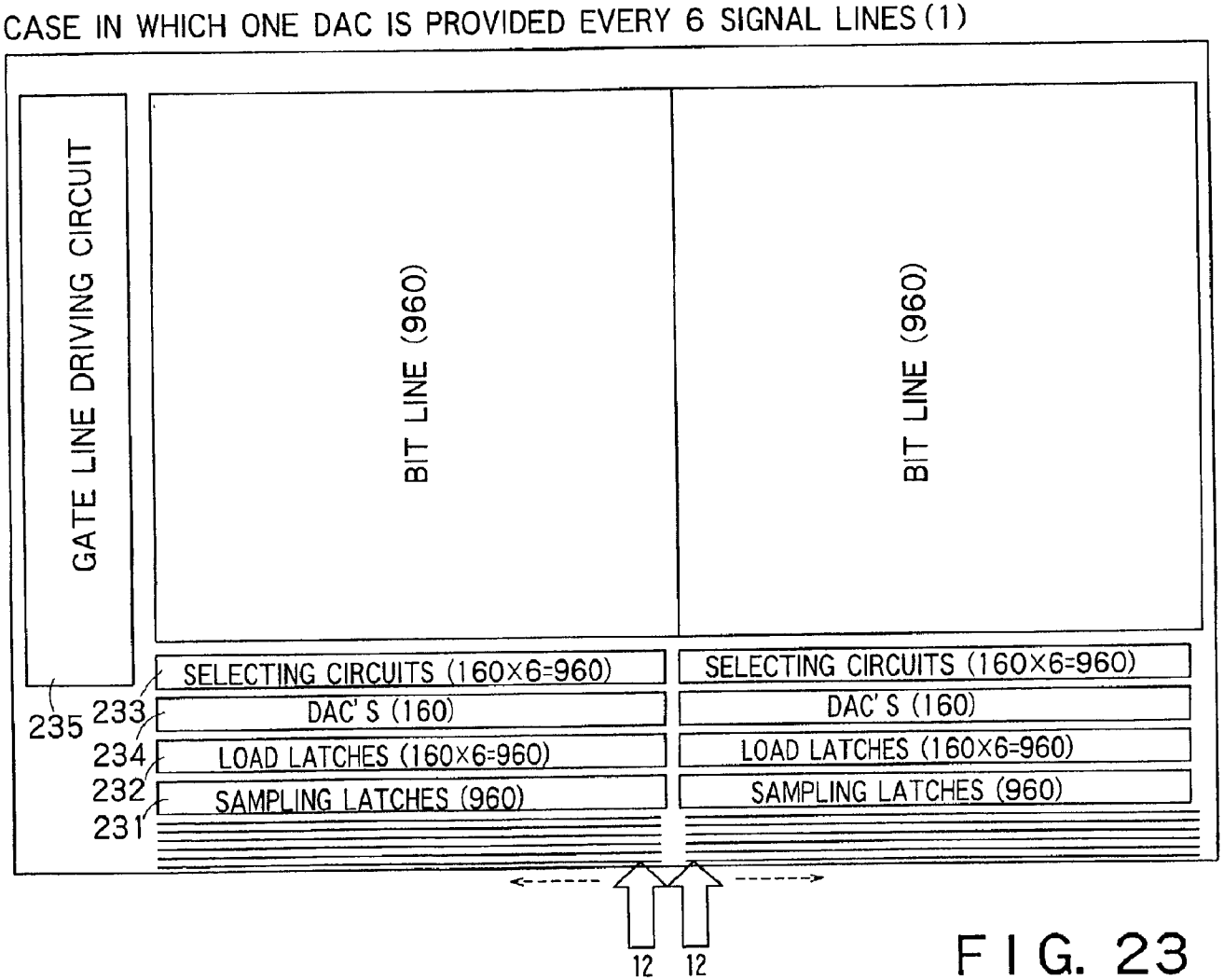
FIG. 23 is a block diagram showing the schematic construction of an EL panel portion 201 in a display apparatus having an active matrix type pixel array portion in the case where signal lines are driven every six lines.

FIG. 23 is a block diagram showing the schematic construction of the EL panel portion 201 in the case where the signal lines are driven every six lines in the display apparatus having the active matrix type pixel array portion 203. In this case, the sampling latches 231 and the load latches 232 are arranged by (160×6 bits=) 960 bits from the center of the pixel array portion 203 to each of the right and left areas. 160 DAC's 234 are provided in each of the right and left areas. The selecting circuits supply 160 outputs of the DAC's 234 to any of the red, green, and blue signal lines in each of the right and left areas. A timing chart in FIG. 23 is the same as that in FIG. 19.

Figure 24:
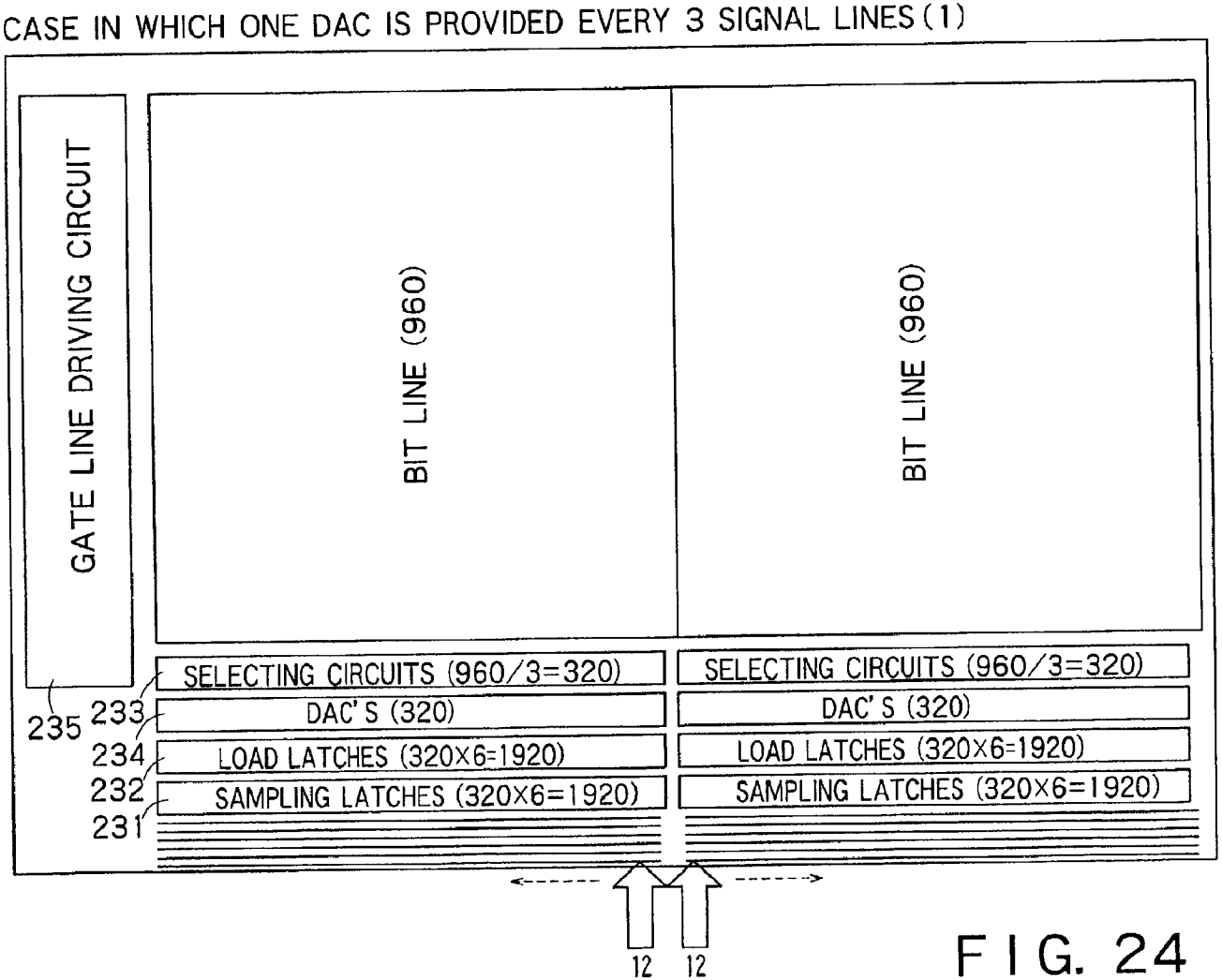
FIG. 24 is a block diagram showing the schematic construction of the EL panel portion when the signal lines are driven every three lines.

On the other hand, FIG. 24 is a block diagram showing the schematic construction of the EL panel portion 201 when the signal lines are driven every three lines. In this case, the sampling latches 231 and the load latches 232 are arranged by (320×6 bits=) 1920 bits from the center of the pixel array portion 203 to each of the right and left areas thereof. The 320 DAC's 234 are arranged in each of the right and left areas. The selecting circuits supply 320 outputs of the DAC's 234 to any of the red, green, and blue signal lines in each of the right and left areas.

Figure 25:
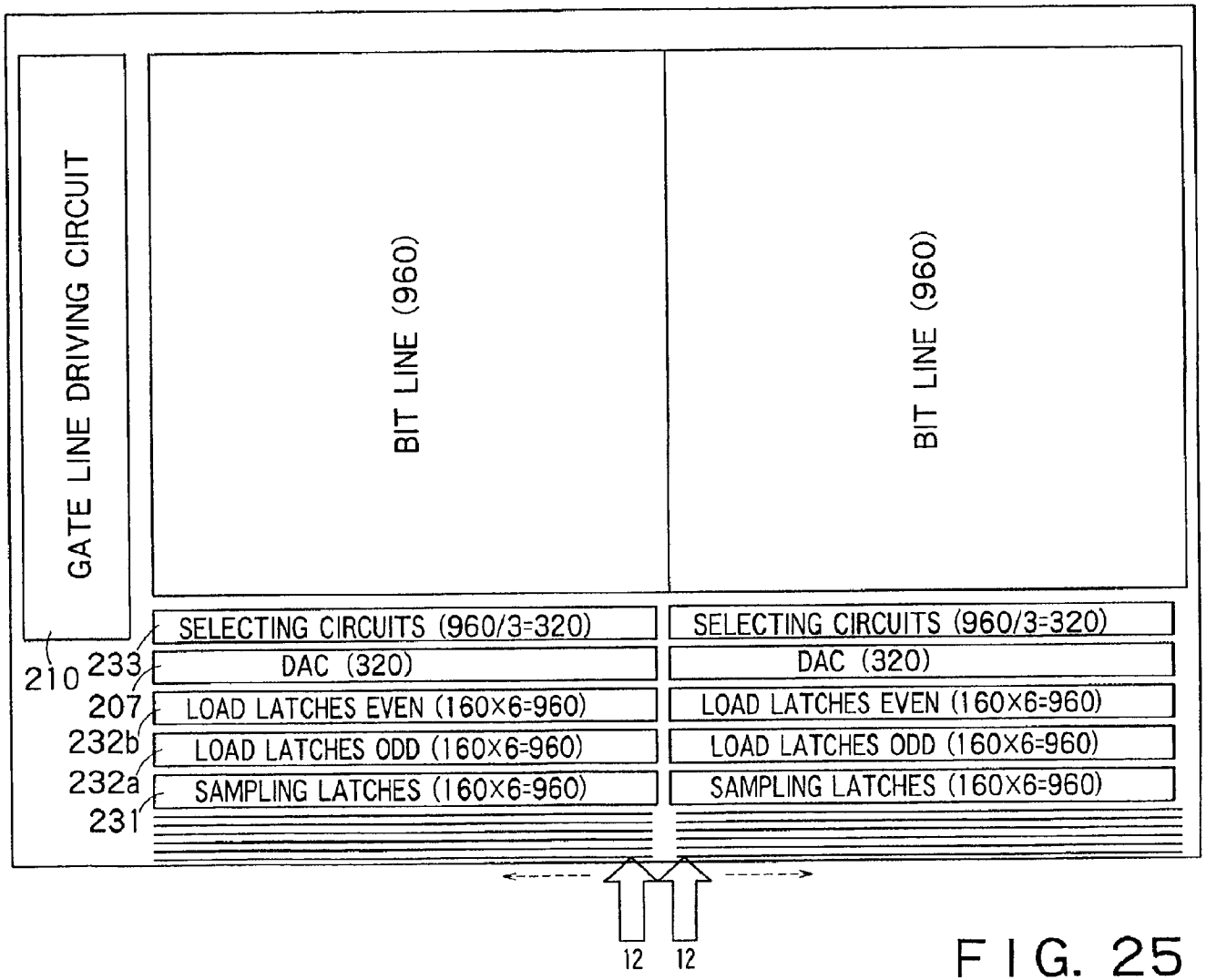
FIG. 25 is a block diagram showing a modification of the construction of FIG. 24.

On the other hand, FIG. 25 shows a modification of the construction in FIG. 24. The construction is the same as that in FIG. 24 with respect to a point that the signal lines are driven every three lines, and has such characteristics that the number of sampling latches 231 is reduced as compared with that in FIG. 24. In the case of FIG. 25, similar to the case of FIG. 24, after the red odd pixel data is transmitted and a small blanking period is elapsed, the red even pixel data is transmitted to the data buses 205*a* and 205*b*. After that, in a manner similar to the above, the green odd and even pixel data and blue odd and even pixel data are transmitted in this order.

The sampling latches 231 are provided by (160×6 bits=) 960 bits and latch only the odd or even pixel data of any color. Among the data latched by the sampling latches 231, the odd pixel data is loaded and stored by the load latches 232*a* and the even pixel data is loaded and stored by the load latches 232*b*.

The DAC's 234D/A convert the data latched by the load latches 232 at the same timing. Namely, the DAC's 234 D/A convert all of the pixel data of any of red, green, and blue in a lump. The selecting circuits supply analog pixel voltages D/A converted by the DAC's 234 to the signal lines of any of red, green, and blue.

The present embodiment illustrates the case in which data is transmitted in the order of R odd, R even, G odd, G even, B odd, and B even. It is also sufficient that after data of one row is D/A converted and is written into the signal line, the order can be changed in the next row like as B odd, B even, G odd, G even, R odd, and R even (the order of selecting the signal lines of the selecting circuits after the DAC's is changed in accordance with the changed order). When attention is paid to a certain signal line, after an analog potential is written, it enters a floating state. There is a case in which when the neighboring signal line is written, the potential of the floating pixel is fluctuated. When the writing order is changed every row as mentioned above, there is such an effect that errors can be diffused.

As in the present embodiment, as for the TFT element formed on the substrate having a large size of several cm, it is inevitable that the characteristics are fluctuated depending on the location. When the sampling circuits in the right half surface and those in the left half surface share a single clock, the timing margin is extremely narrowed. As the display apparatus has a larger screen, the problem becomes serious. As a counter measure, it is effective that the phase and duty of the transmission clock in the data buses 205*a* are adjusted separately from those in the data buses 205*b* and the sampling control with different clocks is performed. The clock selection sequence is executed (1) when the power supply is turned on or (2) during a vertical blanking period. Further in a memory pixel device, it can be executed (3) so as to time such a period that rewritten data is not transmitted.

Figure 26:
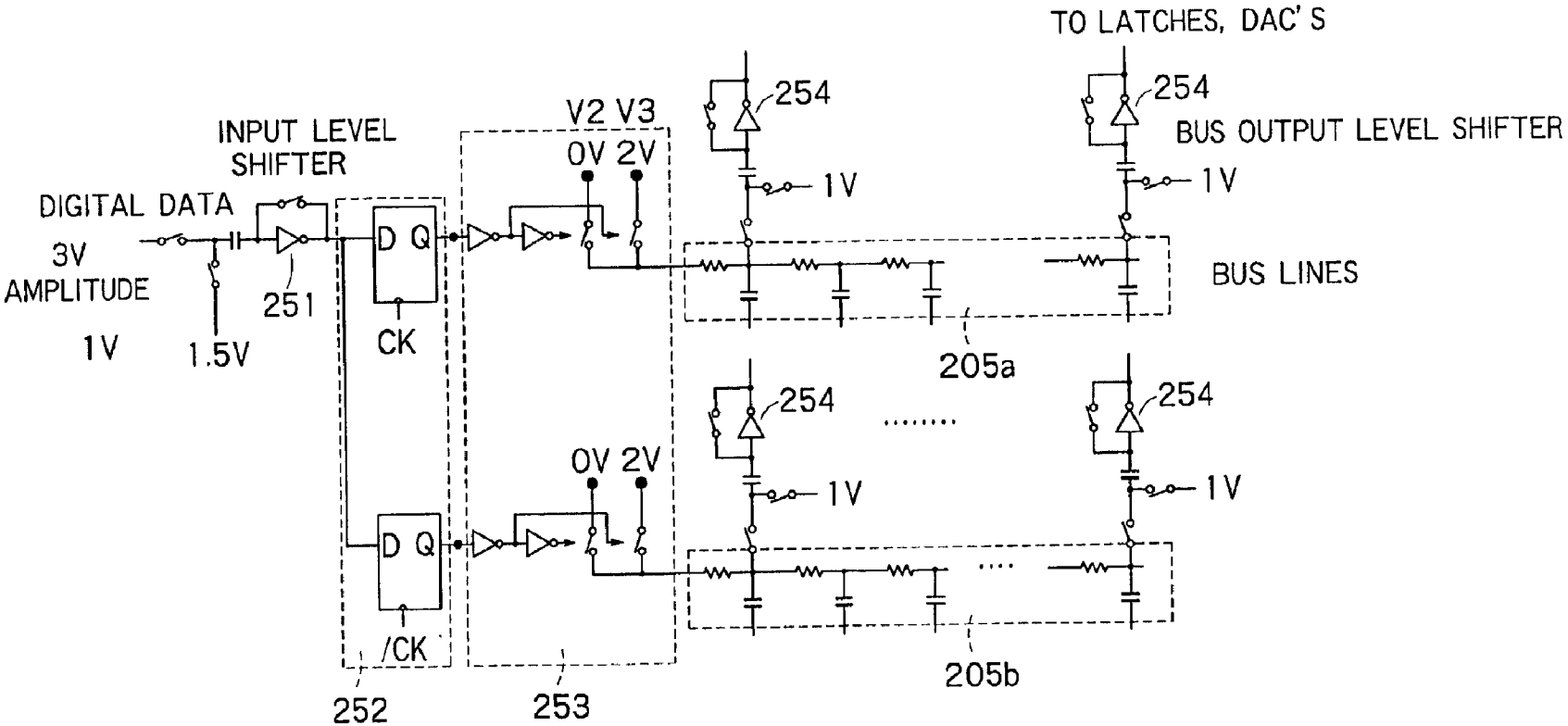
FIG. 26 is a diagram showing a transmission path of digital pixel data.

According to the present embodiment, when the digital pixel data is transmitted from the controller IC 202 to the EL panel portion 201 in FIG. 16, such a level conversion as to convert an LSI-side level (1 to 3 V) to a polysilicon-side level (5V) is performed. FIG. 26 is a diagram showing a transmission path of the digital pixel data. As shown in the diagram, the digital pixel data from the controller IC 202 is data having an amplitude of 3V. After the level conversion, namely, the data is converted into data having an amplitude of 5V by an inverter 251 in the EL panel portion 201, the frequency of the data is adjusted by a frequency dividing circuit 252.

Subsequently, the data is converted into data having an amplitude of 2V by a level converter 253 and, after that, the data is supplied to the data buses 205*a* and 205*b*. The data on each of the data buses 205*a* and 205*b* is converted to data having an amplitude of 3V by a level converting circuit 254. After that, the data is inputted to the sampling latches 231.

As mentioned above, according to the present embodiment, when the digital pixel data is transmitted, the voltage amplitude of the digital pixel data is reduced on the data buses 205*a* and 205*b* each having a long line length, so that a reduction in power consumption can be improved.

The above-mentioned second embodiment illustrates the case in which the data rearranging circuit is provided for the graphic controller. It is essential only that means for changing the output order is provided. For example, the display apparatus according to the present embodiment and a display apparatus having a construction including a system having a CPU and a main memory are possible. That is, the VRAM is provided for a part of the CPU or main memory as required. A capacity thereof is dynamically changed so as to correspond to two screens, one screen, or half screen. As for data transfer, after the output order of data is changed in accordance with software, the data is transmitted to the display apparatus. In the display apparatus in which the memory is provided for each pixel as mentioned in the beginning of the description regarding the second embodiment, the construction is possible.

The above-mentioned second embodiment illustrates the case where the data buses are arranged from the center of the EL panel portion to both the ends thereof. It is also sufficient that three kinds or more of data buses are arranged in the lateral direction of the EL panel portion. Consequently, the load capacity of the data bus can be reduced and the voltage amplitude of data on the data bus can be further reduced as much as the reduced capacity, so that a reduction in power consumption can be improved.

Third Embodiment

According to a third embodiment, signal lines are divided into four blocks and data buses are provided for each block.

Figure 27:
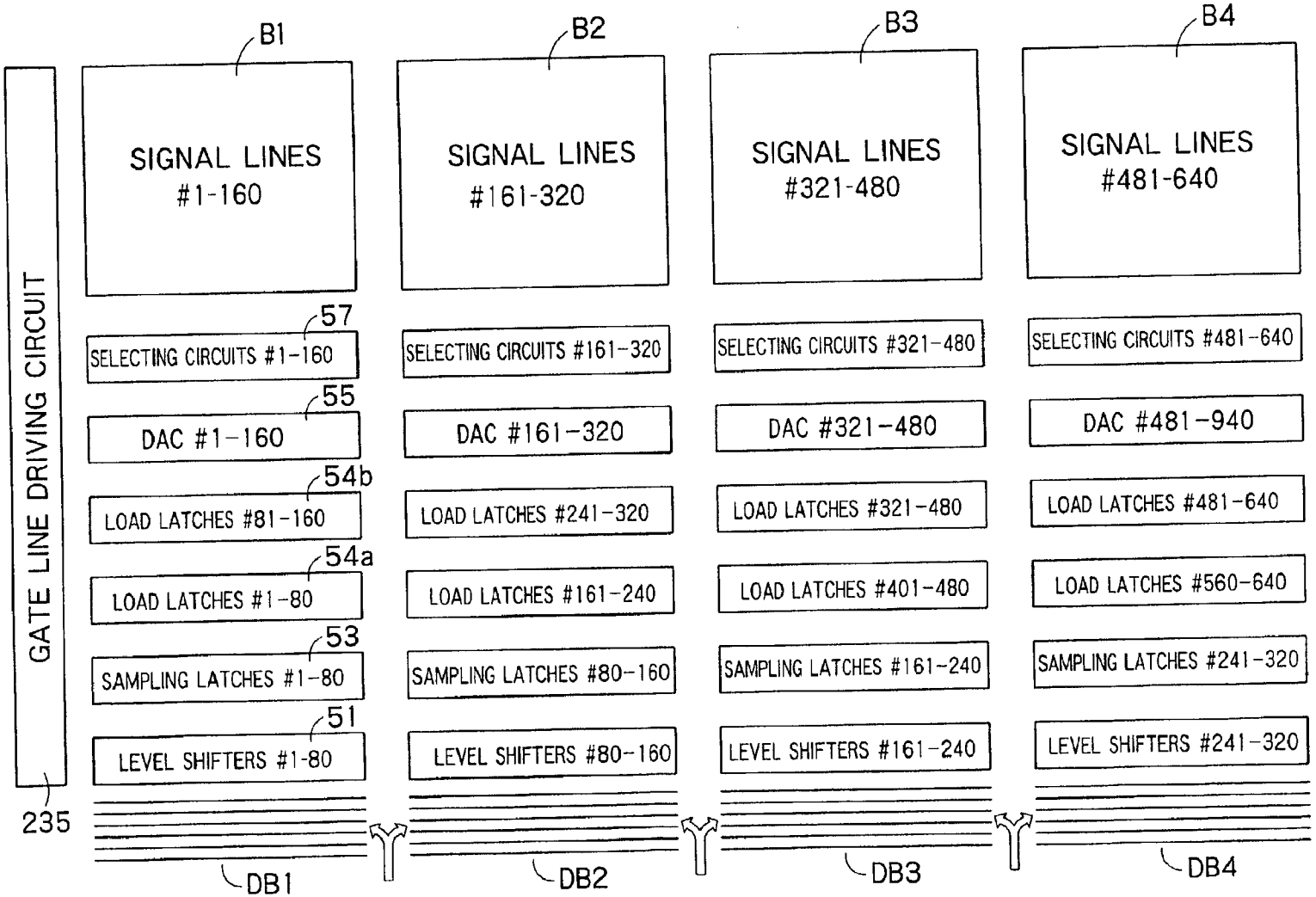
FIG. 27 is a block diagram showing the schematic construction of a signal line driving circuit when the signal lines are divided into four blocks and driven.

FIG. 27 is a block diagram showing the schematic construction of a signal line driving circuit when signal lines are divided into four blocks B1 to B4 and are driven. As shown in the diagram, 160 signal lines for each of RGB are provided for each block and exclusive-use data buses DB1 to DB4 are provided for respective blocks.

First, red odd pixel data of one horizontal line is supplied to the data buses DB1 to DB4 and, after that, red even pixel data is supplied to them. Subsequently, green odd pixel data is supplied and then green even pixel data is supplied. After that, blue odd pixel data is supplied and then blue even pixel data is supplied.

The level of the digital pixel data on the data buses DB1 to DB4 are converted by the level shifters 51. After that, they are latched by the sampling latches 53. (80 pixels×6 bits=) 480 sampling latches 53 are provided for each block. The reason why in spite of the existence of 160 signal lines to be driven in each block, the sampling latches 53 as much as the half of the signal lines are provided is that the neighboring odd pixel and even pixel are driven so as to deviate timing by the same sampling latches 53.

It is possible to provide the sampling latches 53 as much as the number of the load latches 54*a* and 54*b*. The sampling latch 53 of the present embodiment, however, can realize by smaller occupancy area. The load of the data bus becomes small in proportion to the number of the sampling latch 53. Accordingly, it is possible to cut down the signal delay and to reduce power consumption.

At point in time when all the sampling latches 53 complete the latching, the load latches 54*a* and 54*b* latch all of latch outputs of the sampling latches 53 in a lump at the same timing. The load latches 54*a* and 54*b* are divided into two systems. The load latches 54*a* as one system latch all of odd pixels of the same color (red, green, or blue) as much as one horizontal line at the same timing. The load latches 54*b* as the other system latch all of the even pixels of the same color as much as one block at the same timing.

The data latched by the load latches 54*a* and 54*b* are supplied to the D/A converters (DAC's) 55 to be converted into analog pixel voltages and, after that, they are supplied to signal lines selected by the selecting circuits 57.

That is, after the DAC 55 performs D/A conversion for all the red color digital pixel data in the block, for all the green color pixel data in the block, and then for all the blue color pixel data in the block.

According to the present embodiment, when one horizontal line period starts, the sampling latches 53 latches the digital pixel data in sequence of the red color odd pixels, the red color even pixels, the green color odd pixels, the green color even pixels, the blue color odd pixels, an the blue color even pixels.

Figure 28A:
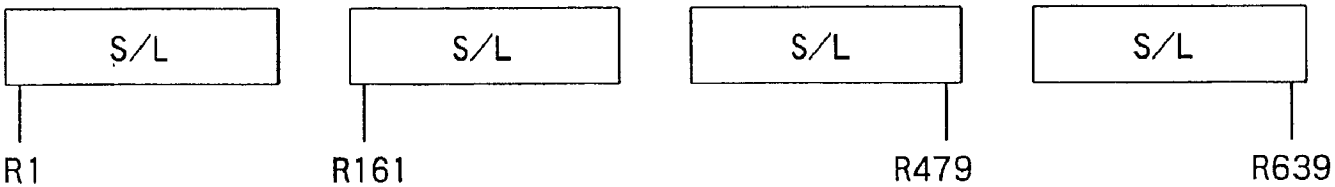
FIGS. 28A to 28C are diagrams showing the order of driving the signal lines.
Figure 28B:
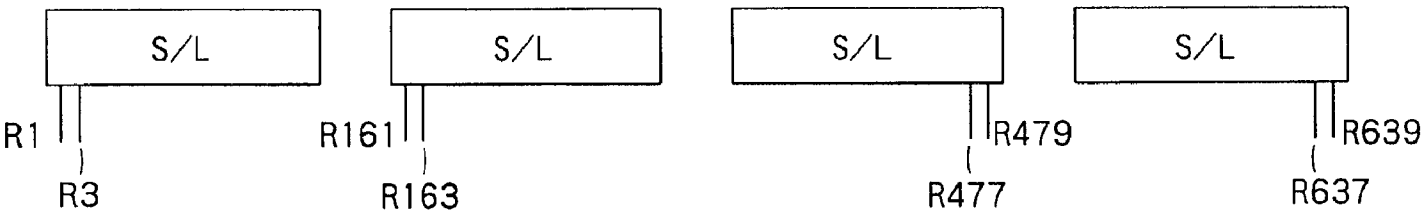
Figure 28C:
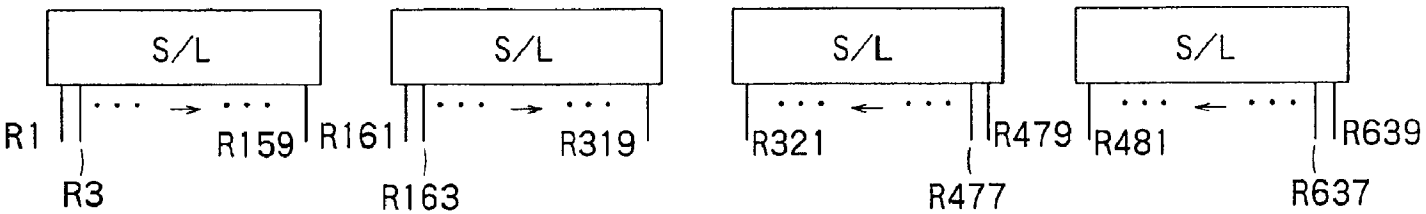

First, as shown in FIG. 28A, the sampling latches 53 latches the digital pixel data of the red color odd pixels R1, R161, R479 and R639. Subsequently, as shown in FIG. 28B, the sampling latches 53 latches the digital pixel data of the neighbor red color odd pixels R3, R163, R477 and R637. Similarly, the sampling latch 53 latches the digital pixel data of the red color odd pixels in sequence. At the last of one horizontal line period, as shown in FIG. 28C, the sampling latches 53 latches the digital image data of the red color odd pixels R159, R319, R321 and R481.

At the time when the sampling latches 53 finish latching the digital pixel data of all the red color odd pixels, the load latches 54*a* simultaneously latches all the digital pixel data of the red color odd pixels that the sampling latches 53 has latched.

Subsequently, the sampling latches 53 latch the digital pixel data of the red color even pixel in sequence by each block. After latching all the red color even pixels, the load latches 54*b* simultaneously latch all the digital pixel data of the red color even pixels.

After all the red color pixel data per one horizontal line latched by the load latches 54*a* and 54*b* is provided to the DAC 55 to perform the D/A conversion, it is simultaneously written into the corresponding signal line.

When the driving of the red pixels is finished, green pixels are subsequently driven in a manner similar to the above and, after that, blue pixels are driven.

Figure 29:
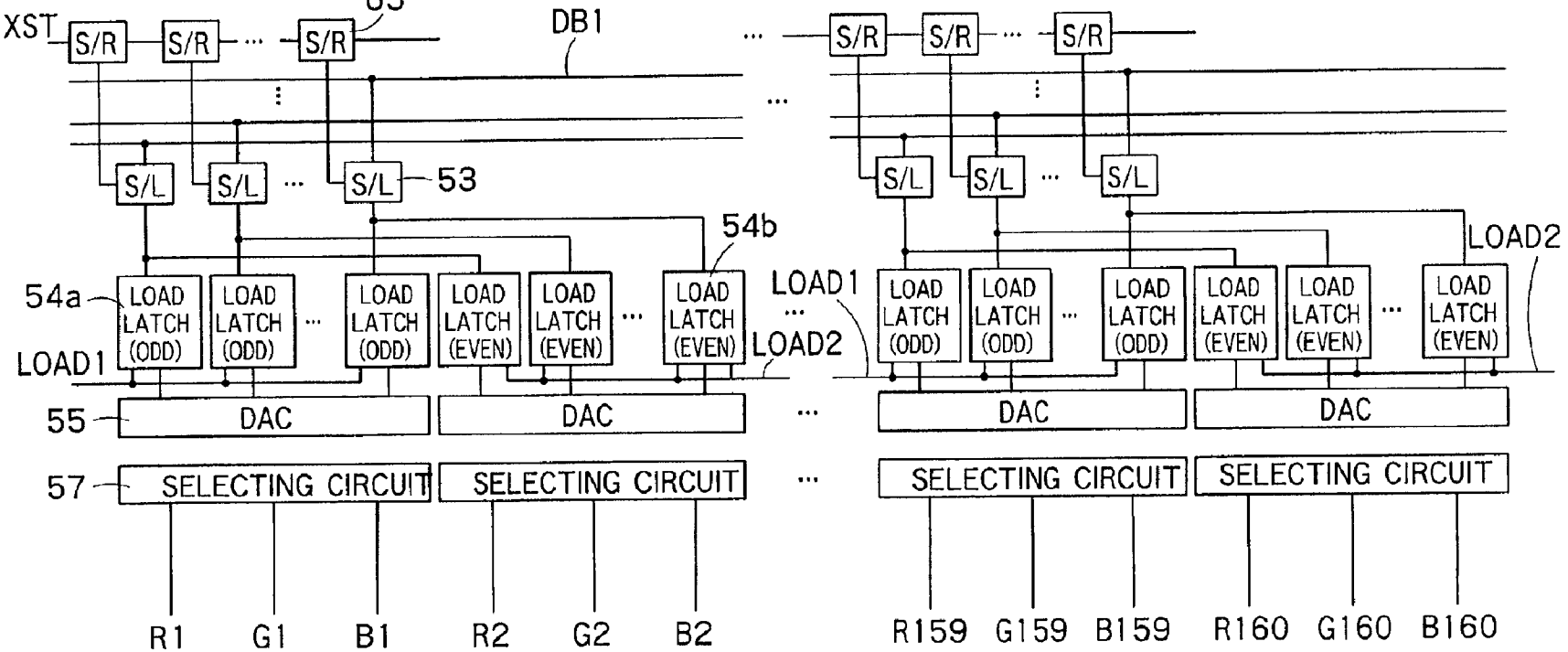
FIG. 29 is a block diagram showing the detailed construction of one block in FIG. 28.
Figure 30:
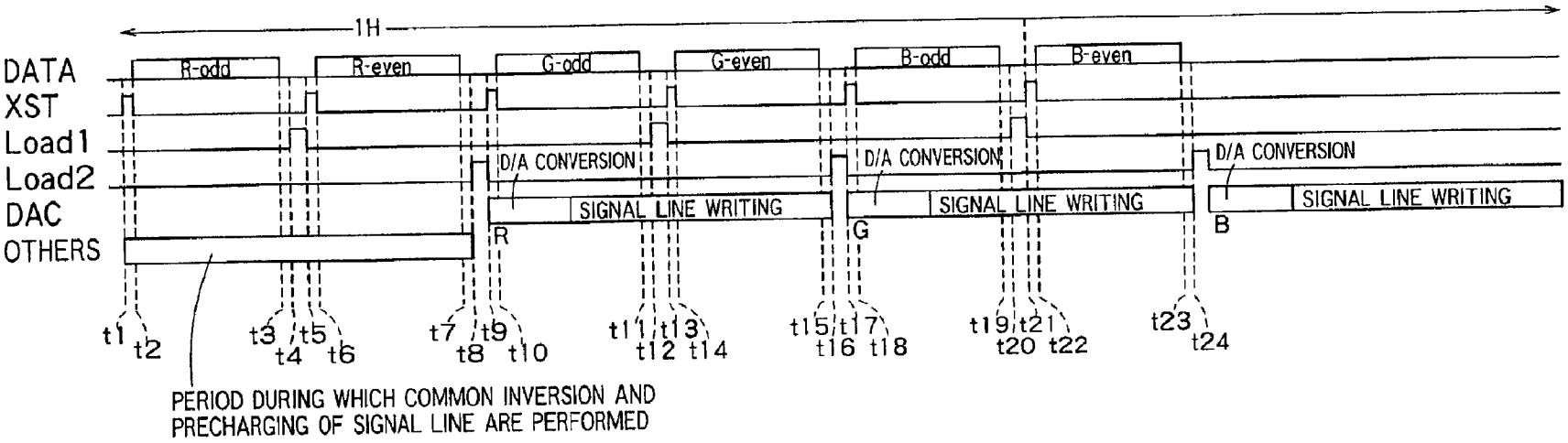
FIG. 30 is an operational timing chart in FIG. 28.

FIG. 29 is a block diagram showing the detailed construction of one block in FIG. 28. FIG. 30 is a timing chart of the operation in FIG. 29. As shown in FIG. 29, output terminals of shift registers 63 generate shift pulses obtained by sequentially shifting a start pulse XST. The shift pulses are used for latching in the sampling latches 53.

First, the sampling latches 53 sequentially latch digital pixel data for red odd pixels (time t2 to t3 in FIG. 30). When the latching in all the sampling latches 53 is finished, the load latches 54*a* simultaneously latch the latch outputs of the sampling latches 53 at timing in time t4.

After that, when the start pulse XST is generated at time t5, the shift registers 63 output the shift pulses obtained by sequentially shifting the start pulse XST. On the basis of the shift pulses, the sampling latches 53 sequentially latch the digital pixel data for the red even pixels (time t6 to t7 in FIG. 30). When the latching of all the sampling latches 53 is finished, the load latches 54*b* simultaneously latch the latch outputs of the sampling latches 53 at timing in time t8.

After that, at time t9, the DAC's 55 convert the latch outputs of the load latches 54*a* and 54*b* into analog pixel voltages. The converted analog pixel voltages are supplied to the signal lines selected by the selecting circuits 57, respectively (time t9 to t16).

Similarly, the sampling latches 53 latch digital pixel data for green odd pixels for a time period from t10 to t11. The load latches 54*a* latch the latch outputs at time t13. After that, the sampling latches 53 latch digital pixel data for green even pixels for a time period from t14 to t15. The load latches 54*b* latch the latch outputs at time t16. The green pixel data latched by the load latches 54*a* and 54*b* are converted into analog voltages by the DAC's 55 for a time period from t17 to t23 and they are supplied to the corresponding signal lines.

Similarly, the sampling latches 53 latch digital pixel data for blue odd pixels for a time period from t18 to t19. The load latches 54*a* latch the latch outputs at time t20. After that, the sampling latches 53 latch digital pixel data for blue even pixels for a time period from t22 to t23. The load latches 54*b* latch the latch output at time t24.

According to the present embodiment, as shown in FIG. 30, a blanking period is set after the end of driving of the signal lines for the red odd pixels before the driving start of the signal lines for the red even pixels (t3 to t6). Similarly, after the end of driving of the signal lines for the red even pixels before the driving start of the signal lines for the green odd pixels (t7 to t10), after the end of driving of the signal lines for the green odd pixels before the driving start of the signal lines for the green even pixels (t11 to t14), after the end of driving of the signal lines for the green even pixels before the driving start of the signal lines for the blue odd pixels (t15 to t18), and after the end of driving of the signal lines for the blue odd pixels before the driving start of the signal lines for the blue even pixels (t19 to t22), blanking periods are set, respectively.

The blanking period is to have time to latch the pixel data which were latched in the sampling latches 53 to the load latch 54*a* or 54*b*.

Figure 31:
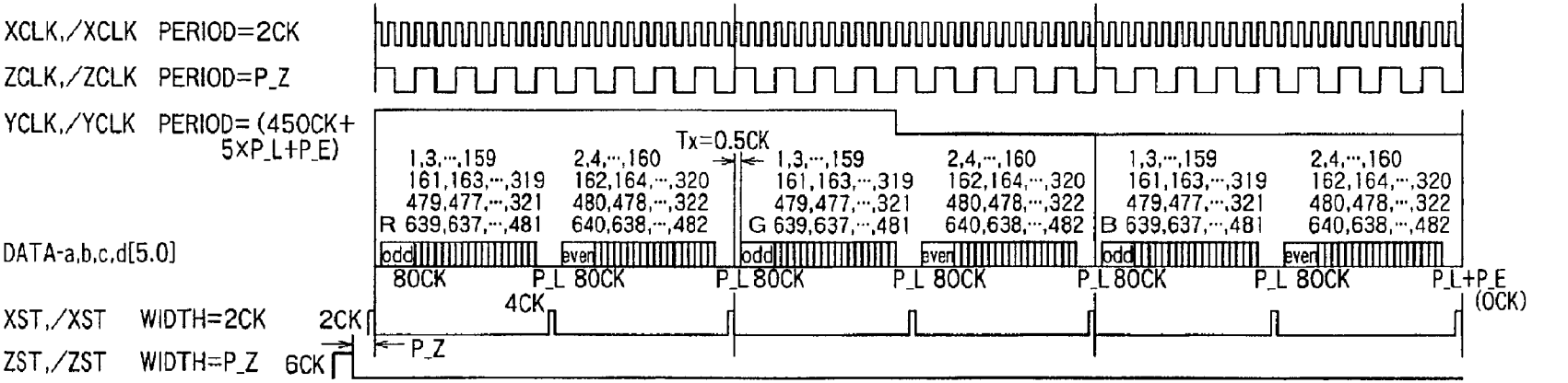
FIG. 31 is a timing chart of various control signals outputted from the graphic controller IC.

FIG. 31 is a timing chart of various control signals outputted from the graphic controller IC. A XCK shown in FIG. 31 has twice cycle as much as that of the pixel data, and a ZCLK has three-fold cycle as much as that of the XCLK. The sampling latches 53 latch the digital pixel data shifted by the clock XCLK in sequence. The signal line driving circuit of the present embodiment has a control signal output portion shown in FIG. 1. The control signal output portion generates signals necessary to control of the DAC 55. The reason why the control signal output portion is necessary is because the DAC 55 formed on the glass substrate is constituted of switched capacitors, analog switches, and so on, and the DAC 55 needs complicated control signals.

The control signal output portion has a counter portion consisted of plenty of counter groups driven by a clock, a combination circuit, and a buffer circuit. The control signal output portion generates desirable timing by the counter block and the combination circuit to output each control signal via a digital buffer. The counter portion is formed by combining the low speed counter portion driven by the low speed clock such as the clock ZCLK with the high speed counter portion driven by the comparatively high speed clock such as the clock XCLK, thereby reducing the number of counters in the counter portion.

The clocks XCLK and ZCLK are outputted from the graphic controller IC. A dividing circuit may be formed on the glass substrate, and the clock ZCLK may be generated based on the clock XCLK. In this case, a prescribed portion on the glass substrate is occupied, and plenty of area is necessary.

The start pulse XST is used to control sampling of the digital pixel data and generate the control signal for the DAC 55. The start pulse ZST is used for common electrode inversion performed once during one horizontal line period, and for generation of control timing such as the signal line precharge. The start pulse YST is used for vertical timing of screen. These three types of the start pulses XST, ZST and YST is important as control signals of the display apparatus. The control signals are generated based on the start pulses, desirably on the glass substrate, thereby completing the control of the signal line driving circuit.

The graphic controller IC of the present embodiment is constructed so as to have any of a full-screen refresh type in which the whole screen is refreshed, a multi-frame period type in which a frame frequency can be variably controlled, and a random access type in which images in an arbitrary area in the display screen can be updated. The graphic controller IC can be also realized by alternately selecting among a plurality of types.

The full-screen refresh type graphic controller IC has the same construction as that shown in FIG. 16.

Figure 32:
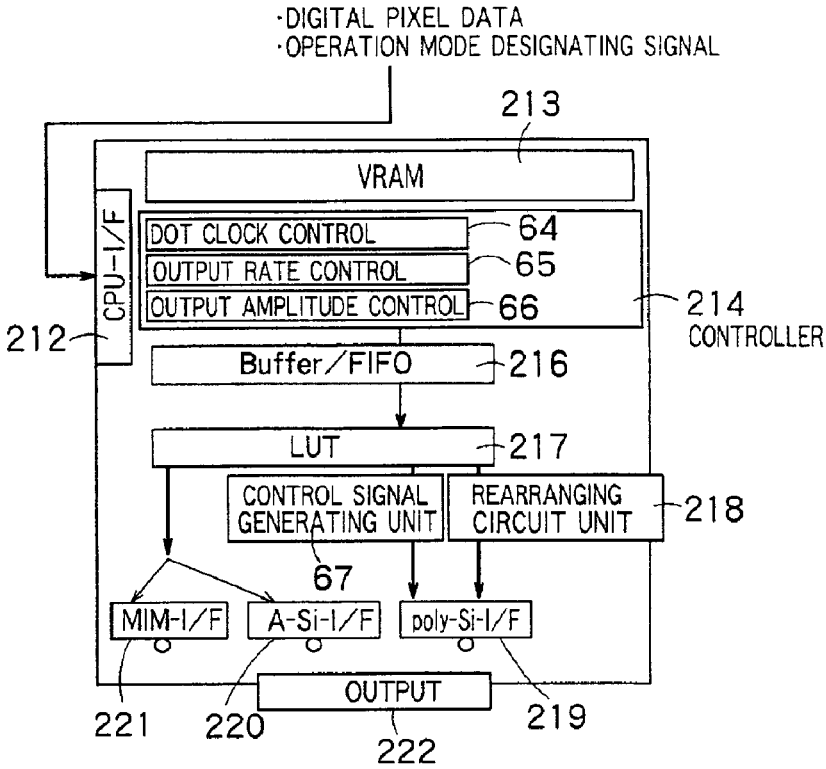
FIG. 32 is a block constructional diagram of a multi-frame period type graphic controller IC.

On the other hand, the multi-frame period type graphic controller IC has a block construction as shown in FIG. 32. The controller 214 in FIG. 32 comprises: a dot clock control unit 64 for controlling the frequency of a pixel clock; an output rate control unit 65 for controlling the output frequency of digital pixel data to be supplied to the glass substrate; and an output amplitude control unit 66 for controlling the output amplitude of the digital pixel data.

For example, in a standby mode of a cellular phone, it is necessary to reduce the power consumption of a display apparatus as much as possible. To reduce the power consumption, it is preferable to reduce the frame frequency. However, when the frame frequency is reduced, flicker stands out conspicuously. Accordingly, it is necessary to perform a process for reducing the number of gray scales of each of RGB to make the flicker inconspicuous. When the frame frequency is lowered, the signal lines can be driven sufficiently on the glass substrate side so long as the amplitude of digital pixel data is reduced.

Generally, the level shifter outputs the signal with a longer rising/falling time as the input amplitude is smaller. The level shifter 51 shown in FIG. 10 has such a feature.

In the graphic controller IC in FIG. 32, when the display apparatus is used in a low power consumption mode, the frequency of the pixel clock is lowered, the output frequency of the digital pixel data is lowered, and the output amplitude of the digital pixel data is also reduced.

Normally, the graphic controller IC operates at the internal voltage 1.5–2V, and has 3V or 3.3V power supply voltage due to restriction of interface from outside in order to enlarge the signal amplitude of only the output portion. When driving at low speed, if the signal amplitude of the output portion sets to 1.5 V or 2V as well as the internal voltage, it is possible to reduce power consumption. Specifically, it is possible to reduce the power of 5–10 mW.

The output frequency of the digital pixel data and a operation mode designation signal to designate the number of pixel gray scales are inputted to the graphic controller IC in FIG. 32. On the basis of the operation mode designating signal, the dot clock control unit 64, output rate control unit 65, and output amplitude control unit 66 control the frequency of the pixel clock and the output frequency and output amplitude of the digital pixel data.

The operation mode designating signal can individually designate the frequency of the pixel clock, output frequency of the digital pixel data, and output amplitude of the digital pixel data.

By sorting out the output terminals of the graphic controller IC corresponding to the display screen, the following advantage is occurred. That is, assuming that a portion in the display screen, for example, right half-face, is full color display of each 6 bits, and the other portion, for example, left half-face, is two values of each color 1 bit, it is unnecessary to almost drive the terminal outputting the image data of left half-face, thereby reducing the power consumption. Furthermore, it is easy that the terminal for the left half-face drives only MSB, and the terminal for the lower bits is pulled down to L power supply.

Figure 33:
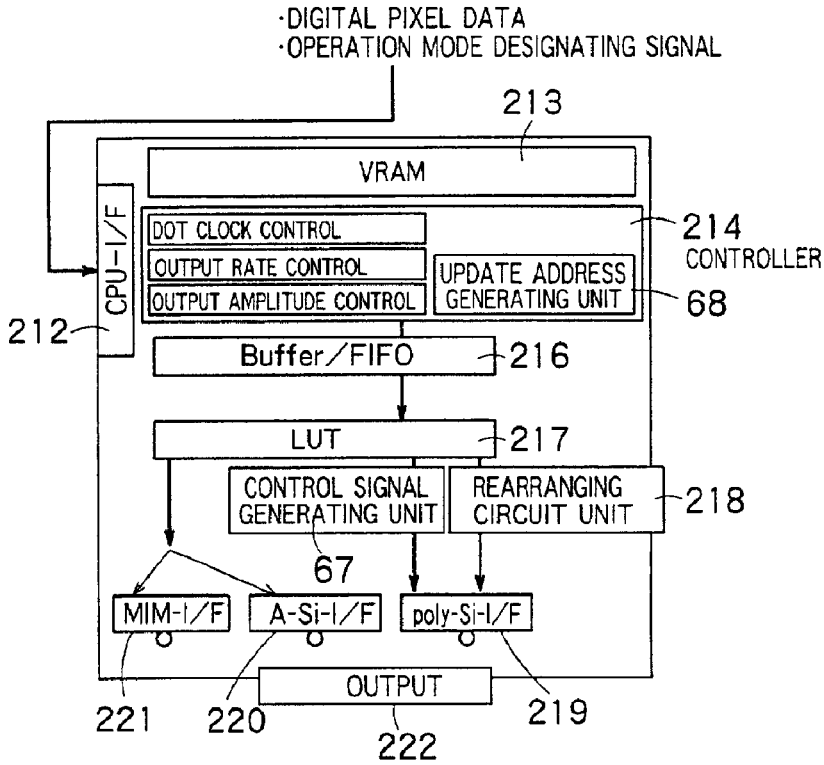
FIG. 33 is a block constructional diagram of a random access type graphic controller IC.

On the other hand, the above-mentioned random access type graphic controller IC has a block construction as shown in FIG. 33. Similar to that of FIG. 32, the graphic controller IC of FIG. 33 has the dot clock control unit 64, output rate control unit 65, and output amplitude control unit 66. In addition to them, the graphic controller IC of FIG. 33 has an update address generating unit 68 for controlling a range to be updated in the display screen and outputting an address signal indicative of an update location.

In a manner similar to that of FIG. 32, the operation mode designating signal is inputted to the graphic controller IC of FIG. 33. The operation mode designating signal includes information indicating whether the display screen is updated and information designating the range to be updated in the display screen. On the basis of the operation mode designating signal, the graphic controller IC of FIG. 33 outputs the address signal indicating the range to be updated in the display screen.

The address signal outputted by the graphic controller IC of FIG. 33 is supplied to the glass substrate. The glass substrate updates images only in the range corresponding to the address signal supplied from the graphic controller IC.

As mentioned above, a reduction in power consumption can be improved by updating the images in the designated range alone.

In FIGS. 32 and 33, the case where a rearranging circuit unit 218 is provided in the graphic controller IC is described. Instead of the rearranging circuit unit 218, as shown in FIG. 34, a readout address generating unit 69 for sequentially forming an address corresponding to data after the rearrangement can be provided in the graphic controller IC.

Figure 34:
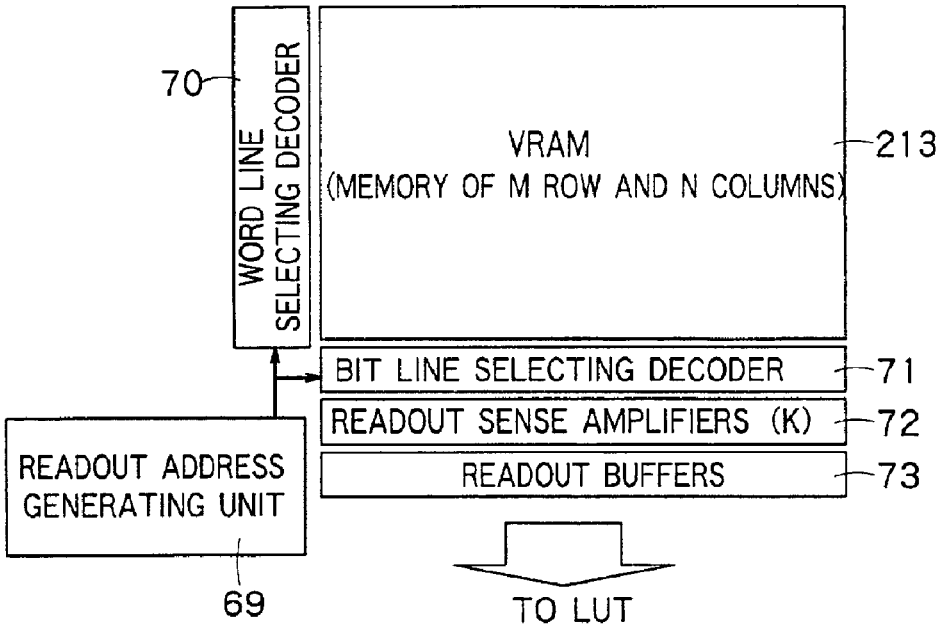
FIG. 34 is a diagram for explaining the reading operation of a VRAM using a readout address generating unit.

The readout address generating circuit 69 in FIG. 34 generates the addresses in the VRAM 213 in the order of supplying digital pixel data to the glass substrate. The address outputted from the readout address generating unit 69 is supplied to the VRAM 213 through a word line selecting decoder 70 and a bit line selecting decoder 71, thereby reading out data of a specific address. The readout data is sensed by each sense amplifier 72 and, after that, the data is supplied to the LUT 217 through each readout buffer 73.

Since the readout address generating circuit unit 69 as shown in FIG. 34 is built in the graphic controller IC, the rearranged data can be read out from the VRAM 213, so that the rearranging circuit unit 218 as shown in FIGS. 32 and 33 is not needed. Consequently, the internal construction of the graphic controller IC can be simplified.

Figure 35:
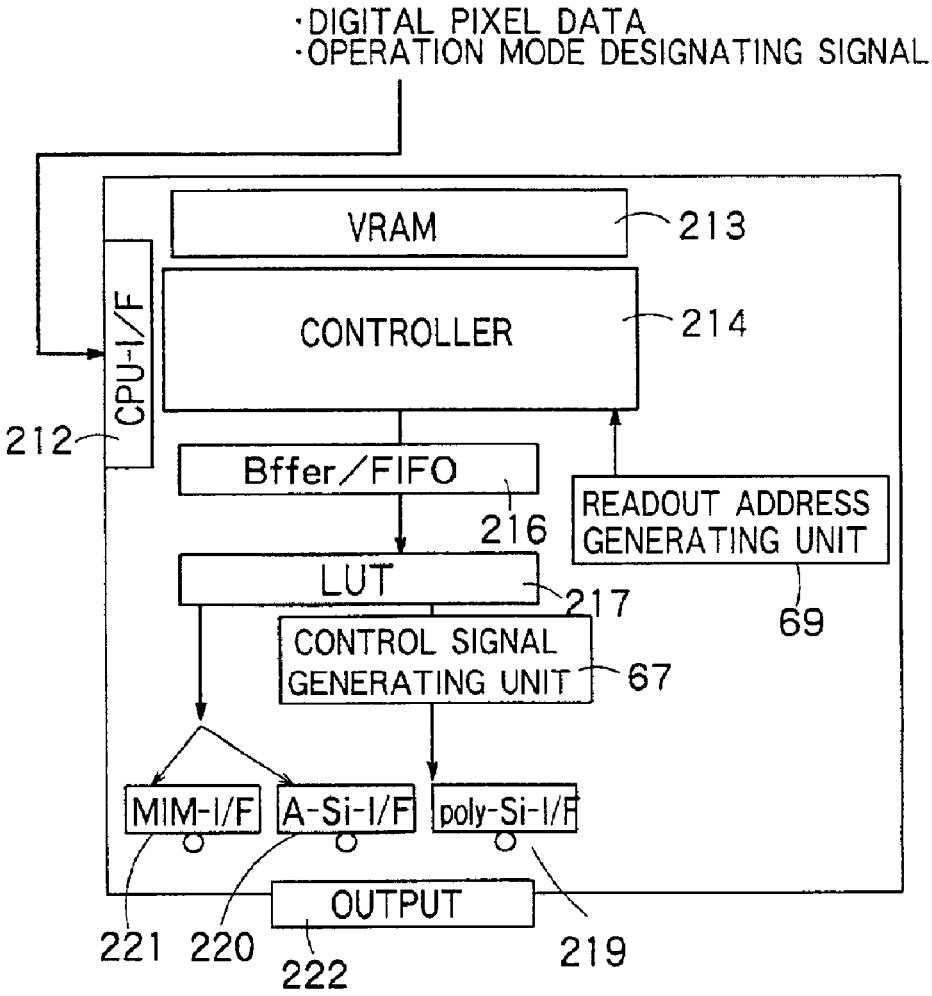
FIG. 35 is a block diagram showing an example in which a readout address generating unit is provided in a full-screen refresh type graphic controller IC.

FIG. 35 is a block diagram showing an example in which instead of the rearranging circuit 218, the readout address generating unit 69 is provided in the full-screen refresh type graphic controller IC. An address outputted from the readout address generating unit 69 is supplied to the VRAM 213 through the controller 214. Data read out from the VRAM 213 is supplied to the glass substrate in the order in which they have been read out.

A data output order change means for combining FIG. 32 with FIG. 35 can be realized. Especially, when the digital pixel data is stored in the frame memory by Yuv form before divided into R, G and B, the output order change is performed as follows. The output order change is divided into two stages, i.e., (A) order change in accordance with block division of the display apparatus, (B) order change by each color and order change by even/odd. By control of an address generator shown in FIG. 35, order change of (A) is performed on the state of Yuv data, and then a LUT converts the Yuv data into RGB data, and then order change of (B) is performed by using a line buffer and so on.

The above-mentioned third embodiment has explained the case in which the signal lines were divided into four blocks and were driven. The number of blocks to be divided is not especially limited. The data of the divided block may be supplied from a corresponding one to the signal line at left end or right end in the block in sequence. Both can realize by changing the start location of the shift register for controlling drive of the sampling latch 53 of the corresponding block.

The above-mentioned embodiment has made explanation regarding the display apparatus having the VGA type (640×480 pixels) display resolution. The display resolution is not limited to the VGA type.

What is claimed is:

1. A display apparatus comprising:

signal lines and scanning lines arranged laterally and longitudinally on an insulating substrate;

display elements formed near respective points of intersection of said signal lines and said scanning lines;

a signal line driving circuit, which is formed on said insulating substrate, configured to drive the signal lines;

a scanning line driving circuit, which is formed on the insulating substrate, configured to drive the scanning lines;

a graphic controller IC configured to output digital pixel data in order according to an order of driving the signal lines by said signal line driving circuit, wherein said graphic controller IC outputs a first clock signal in a cycle twice as much as that of the digital pixel data, the signal line driving circuit and said scanning line driving circuit drive the signal lines and the scanning lines synchronously with the first clock signal, respectively, the graphic controller IC has a pixel data output circuit configured to output the digital pixel data, and said pixel data output circuit outputs an intermediate-level voltage between a high-level voltage and a low-level voltage of the digital pixel data for a period during which a valid digital pixel data is not outputted.

2. The apparatus according to claim 1, wherein the graphic controller IC is mounted on the insulating substrate.

3. The apparatus according to claim 1, wherein the graphic controller IC has a phase adjusting circuit configured to adjust a phase of the digital pixel data and that of the first clock signal.

4. The apparatus according to claim 1, wherein the graphic controller IC outputs a control signal configured to designate a driving start for the signal line driving circuit and the scanning line driving circuit.

5. The apparatus according to claim 1, wherein each of the display elements, the signal line driving circuit, and the scanning line driving circuit is formed by using a polysilicon TFT (Thin Film Transistor), and the graphic controller IC outputs the first clock signal having a frequency at which the polysilicon TFT stably operates.

6. The apparatus according to claim 1, wherein the signal line driving circuit comprises:

latch circuits configured to drive the signal lines every N lines (N is an integer larger than or equal to 2), whose number is a value obtained by dividing a total number of signal lines by N;

D/A converters configured to convert the digital pixel data latched by the latch circuit into an analog voltage, and the graphic controller IC outputs the digital pixel data in accordance with an order of driving the signal lines by the signal line driving circuit.

7. The apparatus according to claim 1, wherein the graphic controller IC outputs a second clock signal, whose phase is shifted from that of the first clock signal by a half cycle.

8. A display apparatus comprising:

signal lines and scanning lines arranged laterally and longitudinally on an insulating substrate;

display elements formed near respective points of intersection of said signal lines and said scanning lines;

a signal line driving circuit, which is formed on said insulating substrate, configured to drive the signal lines;

a scanning line driving circuit, which is formed on the insulating substrate, configured to drive the scanning lines;

a graphic controller IC configured to output digital pixel data in order according to the order of driving the signal lines by said signal line driving circuit, wherein said graphic controller IC outputs a clock signal in a cycle twice as much as that of the digital pixel data, the signal line driving circuit and said scanning line driving circuit drive the signal lines and the scanning lines synchronously with the clock signal, respectively.

the signal line driving circuit has a level converting circuit for a single-phase input, which converts a level of each signal outputted from the graphic controller IC, and said level converting circuit converts the signal outputted from the graphic controller IC into a voltage fluctuating on a threshold voltage of an inverter in the signal line driving circuit by a voltage which changes substantially equally in a vertical direction.

9. The apparatus according to claim 8, wherein the level converting circuit comprises:

a capacitor element whose one terminal is connected to an input terminal;

an inverter connected to another terminal of the capacitor element; and an analog switch connected between input and output terminals of the inverter, and said analog switch is turned on or off to change an input voltage of the inverter by a voltage fluctuating on the threshold voltage of the inverter substantially equally in a vertical direction.

10. The apparatus according to claim 8, wherein the signal line driving circuit has a frequency dividing circuit configured to sequentially latch the digital pixel data after completion of a level conversion by the level converting circuit on a basis of the clock signal and outputting the digital pixel data so as to be distributed in parallel, and the frequency dividing circuit outputs odd-numbered digital pixel data and even-numbered digital pixel data adjacent to the digital pixel data in a cycle twice as much as that of the clock signal.

11. A display apparatus comprising:

signal lines and scanning lines arranged laterally and longitudinally on an insulating substrate;

display elements formed near respective points of intersection of said signal lines and said scanning lines;

a signal line driving circuit, which is formed on the insulating substrate, configured to drive the signal lines;

a scanning line driving circuit, which is formed on the insulating substrate, configured to drive the scanning lines;

a plurality of data buses arranged from substantially a center of one side of the insulating substrate toward both ends of said side;

an order control circuit configured to control an order of digital pixel data transmitted through the data buses so that the signal lines are simultaneously driven every plural lines by said signal line driving circuit;

a first latch circuit configured to sequentially latch digital pixel data supplied to respective signal lines arranged every plural lines;

a second latch circuit configured to simultaneously re-latch all of latch data at a point in time when a latching operation by said first latch circuit is finished once;

D/A converting circuits configured to simultaneously convert respective digital pixel data latched by said second latch circuit into analog pixel voltages; and selecting circuits configured to select the signal lines to which said analog pixel voltages are supplied.

12. The apparatus according to claim 11, wherein the second latch circuit latches the digital pixel data so as to divide the digital pixel data into a plurality of groups, and the D/A converting circuits simultaneously converts the digital pixel data latched by the second latch circuit into the analog pixel voltages for every group.

13. The apparatus according to claim 11, wherein the second latch circuit has first to Nth (N is an integer larger than or equal to 2) latch units, and the D/A converting circuits simultaneously convert the digital pixel data latched by the first to Nth latch units of the second latch circuit into analog pixel voltages.

14. A display apparatus comprising:

signal lines and scanning lines arranged laterally and longitudinally on an insulating substrate;

display elements formed near respective points of intersection of said signal lines and said scanning lines;

a signal line driving circuit, which is formed on the insulating substrate, configured to drive the signal lines;

a scanning line driving circuit, which is formed on the insulating substrate, configured to drive the scanning lines;

a plurality of data buses arranged from substantially a center of one side of the insulating substrate toward both ends of said side;

an order control circuit configured to control an order of digital pixel data transmitted through the data buses so that the signal lines are simultaneously driven every plural lines by said signal line driving circuit;

an address generating circuit configured to generate an address to designate a kind of the display element to which display update is performed;

a first substrate on which the signal lines, scanning lines, display elements, signal line driving circuit, scanning line driving circuit, a writing control circuit, and data buses are formed; and a second substrate on which a rearranging circuit and the address generating circuit are formed, wherein when the digital pixel data is supplied from the rearranging circuit to the data bus, prior to a head data of the digital pixel data, the address from the address generating circuit is outputted from a pixel data output terminal.

15. A display apparatus comprising:

signal lines and scanning lines arranged laterally and longitudinally on an insulating substrate;

display elements formed near respective points of intersection of said signal lines and said scanning lines;

a signal line driving circuit, which is formed on the insulating substrate, configured to drive the signal lines;

a scanning line driving circuit, which is formed on the insulating substrate, configured to drive the scanning lines;

a plurality of data buses arranged from substantially a center of one side of the insulating substrate toward both ends of said side;

an order control circuit configured to control an order of digital pixel data transmitted through the data buses so that the signal lines are simultaneously driven every plural lines by said signal line driving circuit;

an address generating circuit configured to generate an address to designate a range of the display elements to which display update is performed;

a first substrate on which the signal lines, scanning lines, display elements, signal line driving circuit, scanning line driving circuit, a writing control circuit, and data buses are formed; and a second substrate on which a rearranging circuit and the address generating circuit are formed, wherein the address generated by said address generating circuit is outputted from a pixel data output terminal.

16. A display apparatus comprising:

a memory cell comprising a plurality of 1-bit memories arranged laterally and longitudinally;

a display layer in which display can be variably controlled according to the values of the plurality of 1-bit memories;

a writing control circuit configured to control a writing operation to the memory cell;

a plurality of data buses arranged from substantially a center of one side of an insulating substrate toward both ends of said side;

an order control circuit configured to control an order of digital pixel data to be transmitted on the data buses so that the 1-bit memories are simultaneously driven every plural memories by the writing control circuit;

a first latch circuit configured to sequentially latch digital pixel data supplied to the respective 1-bit memories arranged every plural memories;

a second latch circuit configured to simultaneously re-latch all of latch data at a point in time when the latching operation of said first latch circuit is finished once;

a bit line driving circuit configured to amplify a voltage of each digital pixel data latched by said second latch circuit; and selecting circuits configured to select the bit line to supply an output of said bit line driving circuit.

17. A display apparatus comprising:

a memory cell comprising a plurality of 1-bit memories arranged laterally and longitudinally;

a display layer in which display can be variably controlled according to values of the plurality of 1-bit memories;

a writing control circuit configured to control a writing operation to the memory cell;

a plurality of data buses arranged from substantially a center of one side of an insulating substrate toward both ends of said side;

an order control circuit configured to control an order of digital pixel data to be transmitted on the data buses so that the 1-bit memories are simultaneously driven every plural memories by the writing control circuit;

an address generating circuit configured to generate an address to designate a range in which data in the memory cell is rewritten;

a first substrate on which the memory cell, writing control circuit, and data buses are formed; and a second substrate on which a rearranging circuit and the address generating circuit are formed, wherein when the digital pixel data is supplied from the rearranging circuit to the data bus, prior to a head data of the digital pixel data, the address is outputted from a pixel data output terminal.

18. A display apparatus comprising:

a memory cell comprising a plurality of 1-bit memories arranged laterally and longitudinally;

a display layer in which display can be variably controlled according to values of the plurality of 1-bit memories;

a writing control circuit configured to control a writing operation to the memory cell;

a plurality of data buses arranged from substantially a center of one side of an insulating substrate toward both the ends of said side;

an address generating circuit configured to generate an address to designate a range in which data in the memory cell is rewritten;

a first substrate on which the memory cell, writing control circuit, and data buses are formed; and a second substrate on which a rearranging circuit and the address generating circuit are formed, wherein the address generated from the address generating circuit is supplied to the first substrate by using an enable signal line transmitted from the second substrate to the first substrate.

19. A display apparatus comprising:

signal lines and scanning lines arranged laterally and longitudinally on an insulating substrate;

display elements formed near respective points of intersection of said signal lines and said scanning lines;

a signal line driving circuit, which is formed on the insulating substrate, configured to drive the signal lines;

a scanning line driving circuit, which is formed on the insulating substrate, configured to drive the scanning lines;

a plurality of data buses arranged from substantially a center of one side of the insulating substrate toward both ends of said side;

an order control circuit configured to control an order of digital pixel data transmitted through the data buses so that the signal lines are simultaneously driven every plural lines by said signal line driving circuit;

a first latch circuit configured to sequentially latch digital pixel data supplied to respective signal lines arranged every plural lines;

a second latch circuit configured to simultaneously re-latch all of latch data at a point in time when a latching operation by said first latch circuit is finished once;

D/A converting circuits configured to simultaneously convert respective digital pixel data latched by said second latch circuit into analog pixel voltages;

selecting circuits configured to select the signal lines to which said analog pixel voltages are supplied;

a first level converting circuit configured to convert a level of digital pixel data supplied from outside to data having a first voltage amplitude;

a frequency dividing circuit configured to divide a frequency of a data level-converted by the first level converting circuit;

a second level converting circuit configured to convert a level of data whose frequency is divided by the frequency dividing circuit into data having a second voltage amplitude smaller than the first voltage amplitude, and supplying converted data to the data bus; and a third level converting circuit configured to convert the level of data on the data bus into data having a third voltage amplitude larger than the second voltage amplitude, and supplying the converted data to the first latch circuit.

20. A display apparatus comprising:

signal lines and scanning lines arranged laterally and longitudinally on an insulating substrate;

display elements formed near respective points of intersection of said signal lines and said scanning lines;

a signal line driving circuit, which is formed on said insulating substrate, configured to drive the signal lines; and a scanning line driving circuit, which is formed on the insulating substrate, configured to drive the scanning lines, wherein the signal line driving circuit latches on a state of separating the digital pixel data of a first color in one horizontal line into odd pixels and even pixels, and then after passing a prescribed period, latches on a state of separating the digital pixel data of a second color into odd pixels and even pixels, and performs D/A conversion for latched data of said first color, and supplies D/A converted data to a corresponding signal line, and then after passing a prescribed period, latches on a state of separating the digital pixel data of a third color into odd pixels and even pixels, and performs D/A conversion for latched data of said second color, and supplies D/A converted data to a corresponding signal line, and then after passing a prescribed period, performs D/A conversion for latched data of said third color, and then after passing a prescribed period, supplies D/A converted data to corresponding signal line.

21. The apparatus according to claim 20, wherein the signal lines on the insulating substrate are divided into n blocks (n is an integer larger than or equal to 2), and the signal lines on said insulating substrate are divided into n blocks (n is an integer larger than or equal to 2);

the apparatus further comprising;

a first block circuit configured to latch on the state of separating the digital pixel data of a first color in one horizontal line into the odd pixels and the even pixels, and then after passing a prescribed period, latches on the state of separating the digital pixel data of a second color into the odd pixels and the even pixels, and performs D/A conversion for the latched data of said first color, and supplies the D/A converted data to the corresponding signal line, and then after passing a prescribed period, latches on the state of separating the digital pixel data of a third color into the odd pixels and the even pixels, and performs D/A conversion for the latched data of said second color, and supplies the D/A converted data to the corresponding signal line, and then after passing a prescribed period, performs D/A conversion for the latched data of said third color, and supplies the D/A converted data to the corresponding signal line, by each block;

a second latch circuit configured to simultaneously latch the latched output of all the odd pixels of said first, second and third colors among the latched output of said first latch circuit, by each block;

a third latch circuit configured to simultaneously latch a latched output of all the even pixels of said first, second and third colors among a latched output of said first latch circuit, by each block;

a D/A converter configured to simultaneously convert the latched output of said second and third latch circuit into analog pixel voltages, by each block; and a selecting circuit configured to provide the analog pixel voltages converted by said D/A converter to a corresponding signal line.

22. An image control semiconductor device comprising:

a VRAM control unit configured to control a reading/writing operation of an image memory to store digital pixel data;

an output order control circuit configured to change output order of said digital pixel data in accordance with an order of driving signal lines;

a pixel data output unit configured to divide a plurality of signal lines arranged on an insulating substrate into n blocks (n is an integer larger than or equal to 2) and outputting the digital pixel data rearranged by said output order control circuit in parallel to said respective n blocks in parallel; and a first start pulse output unit configured to output a first start pulse signal to designate a driving start of a signal line driving circuit for each of said n blocks, wherein said pixel data output unit divides said digital pixel data into a plurality of consecutive output data group, and outputs in sequence each of a consecutive output data group by spacing a prescribed period.

23. The device according to claim 22, wherein said output order control circuit controls output order so that the digital pixel data of a first color in one horizontal line is latched on a state of being separated into odd pixels and even pixels, and then after passing a prescribed period, the digital pixel data of a second color is latched on a state of being separated into odd pixels and even pixels, and D/A conversion for latched data of said first color is performed, and D/A converted data is supplied to a corresponding signal line, and then after passing a prescribed period, the digital pixel data of a third color is latched on a state of being separated into odd pixels and even pixels, and D/A conversion is performed for latched data of said second color, and D/A converted data is supplied to a corresponding signal line, and then after passing a prescribed period, D/A conversion for latched data of said third color is performed, and D/A converted data is supplied to corresponding signal line.

24. The device according to claim 22, further comprising:

a double frequency clock output unit configured to output a pixel clock having a frequency twice as high as a display frequency of one pixel; and a phase adjusting unit configured to adjust phase difference between said digital pixel data and said pixel clock.

25. The device according to claim 24, further comprising:

a dividing clock output unit configured to output a clock of dividing a pixel clock; and a second start pulse output unit configured to output a second start pulse signal having a cycle equal to display period of one horizontal line.

26. The device according to claim 22, wherein said digital pixel data is composed of k bits (k is an integer of 2 or more), and the device further comprises an output frequency control unit configured to change output frequency and output amplitude of the digital pixel data outputted from said pixel data output unit, based on an inputted operation mode indicating signal.

27. The device according to claim 26, wherein said inputted operation mode indicating signal includes information regarding invalid bits of the digital pixel data and the bits other than indicated bits of the digital pixel data are fixed to a predetermined logic.

28. The device according to claim 22, further comprising:

an output frequency control unit configured to change output frequency and output amplitude of the digital pixel data outputted from said pixel data output unit, based on an inputted operation mode indicating signal.

29. The device according to claim 26, wherein the inputted operation mode indicating signal includes information configured to designate area configured to update the pixel data in display screen, and said output order control circuit outputs new digital pixel data only for area designated by said operation mode indicating signal.

30. An image control semiconductor device comprising:

a VRAM control unit configured to control the reading/writing operation of an image memory to store digital pixel data;

a readout address generating unit configured to form a readout address of the image memory;

a pixel data output unit configured to divide a plurality of signal lines arranged on an insulating substrate into n blocks (n is an integer larger than or equal to 2) and outputting digital pixel data read out from said image memory in accordance with the readout address formed by said readout address generating unit in parallel to said n blocks, respectively; and a first start pulse output unit configured to output a first start pulse signal to designate a driving start of signal lines to the n blocks, respectively, wherein the readout address generating unit generates read-out address of said image memory so that the digital pixel data in said block is divided into p consecutive outputted small data groups (p is an integer of 2 or more), and each of these small data groups is outputted by spacing a prescribed period.

31. An image control semiconductor device comprising:

a VRAM control unit configured to control read/write for an image memory configured to store digital pixel data;

a read-out address generator configured to generate read address of said image memory;

first order control means for dividing a plurality of signal lines arranged on an insulating substrate into n blocks (n is an integer larger than or equal to 2) and to read out the digital pixel data corresponding to the read address generated by said read-out address generator from said image memory, by each of said n blocks;

second order control means for change order of the digital pixel data by each of said n blocks read out by said first order control means into p consecutive outputted small data groups (p is an integer of 2 or more), and to output each of these small data groups by spacing a prescribed period; and a terminal configured to output a start pulse prior to each of the p small data groups.

32. A method configured to drive a display apparatus comprising: signal lines and scanning lines arranged laterally and longitudinally on an insulating substrate; display elements formed near respective points of intersection of the signal lines and the scanning lines; a signal line driving circuit, which is formed on the insulating substrate, configured to drive respective signal lines; and a scanning line driving circuit, which is formed on the insulating substrate, configured to drive respective scanning lines, wherein the digital pixel data of a first color in one horizontal line is latched on a state of being separated into odd pixels and even pixels, and then after passing a prescribed period, the digital pixel data of a second color is latched on a state of being separated into odd pixels and even pixels, and D/A conversion for latched data of said first color is performed, and D/A converted data is supplied to a corresponding signal line, and then after passing a prescribed period, the digital pixel data of a third color is latched on a state of being separated into odd pixels and even pixels, and D/A conversion is performed for latched data of said second color, and D/A converted data is supplied to a corresponding signal line, and then after passing a prescribed period, D/A conversion for latched data of said third color is performed, and D/A converted data is supplied to a corresponding signal line.

* * * * *